US007224209B2

(12) United States Patent
Hsu

(10) Patent No.: US 7,224,209 B2
(45) Date of Patent: May 29, 2007

(54) SPEED-UP CIRCUIT FOR INITIATION OF PROPORTIONAL TO ABSOLUTE TEMPERATURE BIASING CIRCUITS

(75) Inventor: Jenshou Hsu, Hsin-chu (TW)

(73) Assignee: Etron Technology, Inc., Hsin-Chu (TW)

( * ) Notice: Subject to any disclaimer, the term of this patent is extended or adjusted under 35 U.S.C. 154(b) by 125 days.

(21) Appl. No.: 11/071,489

(22) Filed: Mar. 3, 2005

(65) Prior Publication Data

US 2006/0197584 A1 Sep. 7, 2006

(51) Int. Cl.
*G05F 1/10* (2006.01)

(52) U.S. Cl. ..... 327/538; 327/539; 327/540; 327/541; 327/542; 323/312; 323/313; 323/314

(58) Field of Classification Search ..... 327/538–542
See application file for complete search history.

(56) References Cited

U.S. PATENT DOCUMENTS

| | | | | |
|---|---|---|---|---|
| 4,839,535 | A | 6/1989 | Miller | 307/296.7 |
| 5,087,830 | A | 2/1992 | Cave et al. | 307/296.6 |
| 5,545,978 | A | 8/1996 | Pontius | 323/313 |
| 5,610,506 | A | 3/1997 | McIntyre | 323/313 |
| 5,900,773 | A * | 5/1999 | Susak | 327/539 |
| 6,084,388 | A | 7/2000 | Toosky | 323/313 |
| 6,133,719 | A | 10/2000 | Maulik | 323/313 |
| 6,335,614 | B1 | 1/2002 | Ganti | 323/317 |
| 6,392,470 | B1 | 5/2002 | Burstein et al. | 327/539 |
| 6,509,726 | B1 | 1/2003 | Roh | 232/313 |
| 6,529,066 | B1 * | 3/2003 | Guenot et al. | 327/539 |
| 6,566,850 | B2 | 5/2003 | Heinrich | 323/313 |
| 6,642,776 | B1 | 11/2003 | Micheloni et al. | 327/539 |
| 6,661,713 | B1 * | 12/2003 | Kuo | 365/189.09 |
| 6,710,641 | B1 | 3/2004 | Yu et al. | 327/539 |
| 6,737,908 | B2 * | 5/2004 | Mottola et al. | 327/539 |
| 6,774,711 | B2 * | 8/2004 | Bernard | 327/539 |
| 6,885,178 | B2 * | 4/2005 | Marinca | 323/316 |
| 6,906,581 | B2 * | 6/2005 | Kang et al. | 327/539 |
| 7,034,514 | B2 * | 4/2006 | Tachibana et al. | 323/313 |
| 7,071,673 | B2 * | 7/2006 | Menegoli et al. | 323/315 |
| 7,116,158 | B2 * | 10/2006 | Teel et al. | 327/539 |
| 7,119,527 | B2 * | 10/2006 | Fernald | 323/315 |
| 7,119,528 | B1 * | 10/2006 | Rasmus | 323/317 |
| 7,119,620 | B2 * | 10/2006 | Pan | 330/289 |
| 7,164,260 | B2 * | 1/2007 | Neaves | 323/316 |
| 7,170,274 | B2 * | 1/2007 | Mukherjee et al. | 323/313 |

(Continued)

OTHER PUBLICATIONS

Design of Analog Integrated Circuits, Razavi, 2001, McGraw Hill, New York, NY, pp. 377-381.
"A Bandgap Voltage Reference Using Digital CMOS Process", Vermaas et al., Proceedings—1998, pp. 303-306, vol. 2.

(Continued)

*Primary Examiner*—Tuan T. Lam
*Assistant Examiner*—Hiep Nguyen
(74) *Attorney, Agent, or Firm*—Saile Ackerman LLC; Stephen B. Ackerman; Billy Knowles

(57) ABSTRACT

A PTAT biasing circuit for use in a bandgap referenced voltage source includes a startup sub-circuit. Prior to activation of a power up indication signal, the speedup circuit forces the PTAT biasing circuit from a degenerate operating point to a normal operating point. Upon detection of a feedback signal denoting the initiation of the PTAT biasing circuit, the startup sub-circuit terminates operation of the startup sub-circuit independent of the activation of the power up indication signal.

22 Claims, 15 Drawing Sheets

U.S. PATENT DOCUMENTS

| | | | | |
|---|---|---|---|---|
| 7,170,336 | B2 * | 1/2007 | Hsu | 327/539 |
| 2002/0125937 | A1 | 9/2002 | Park et al. | 327/539 |
| 2003/0080806 | A1 | 5/2003 | Sugimura | 327/539 |
| 2003/0201822 | A1 | 10/2003 | Kang et al. | 327/539 |

OTHER PUBLICATIONS

"The Design of Band-Gap Reference Circuits:Trials and Tribulations," Pease, Proc. of the 1990 Bipolar Cir. and Tech. Mtg., 1990, pp. 214-218.

* cited by examiner

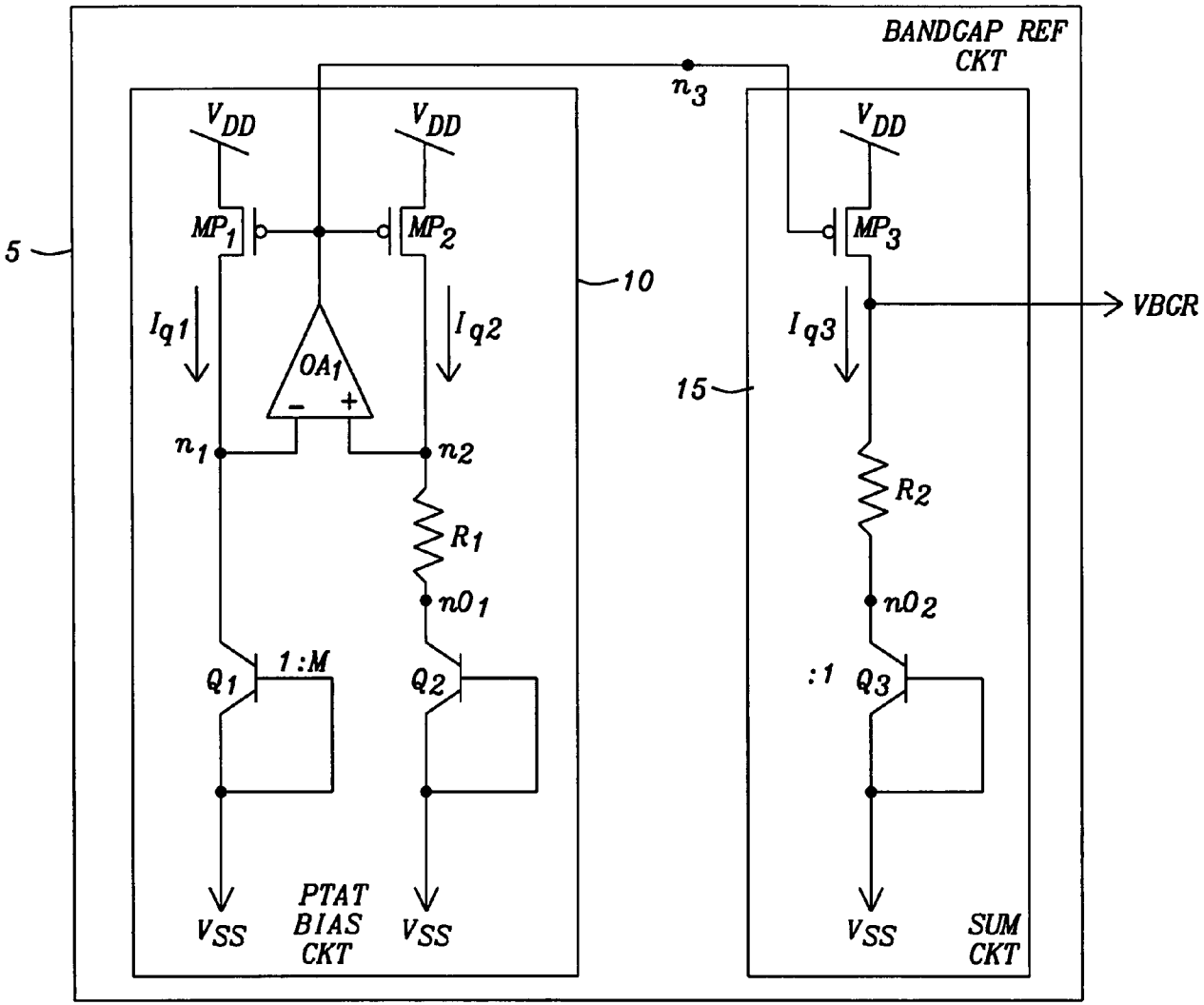
FIG. 1 – Prior Art

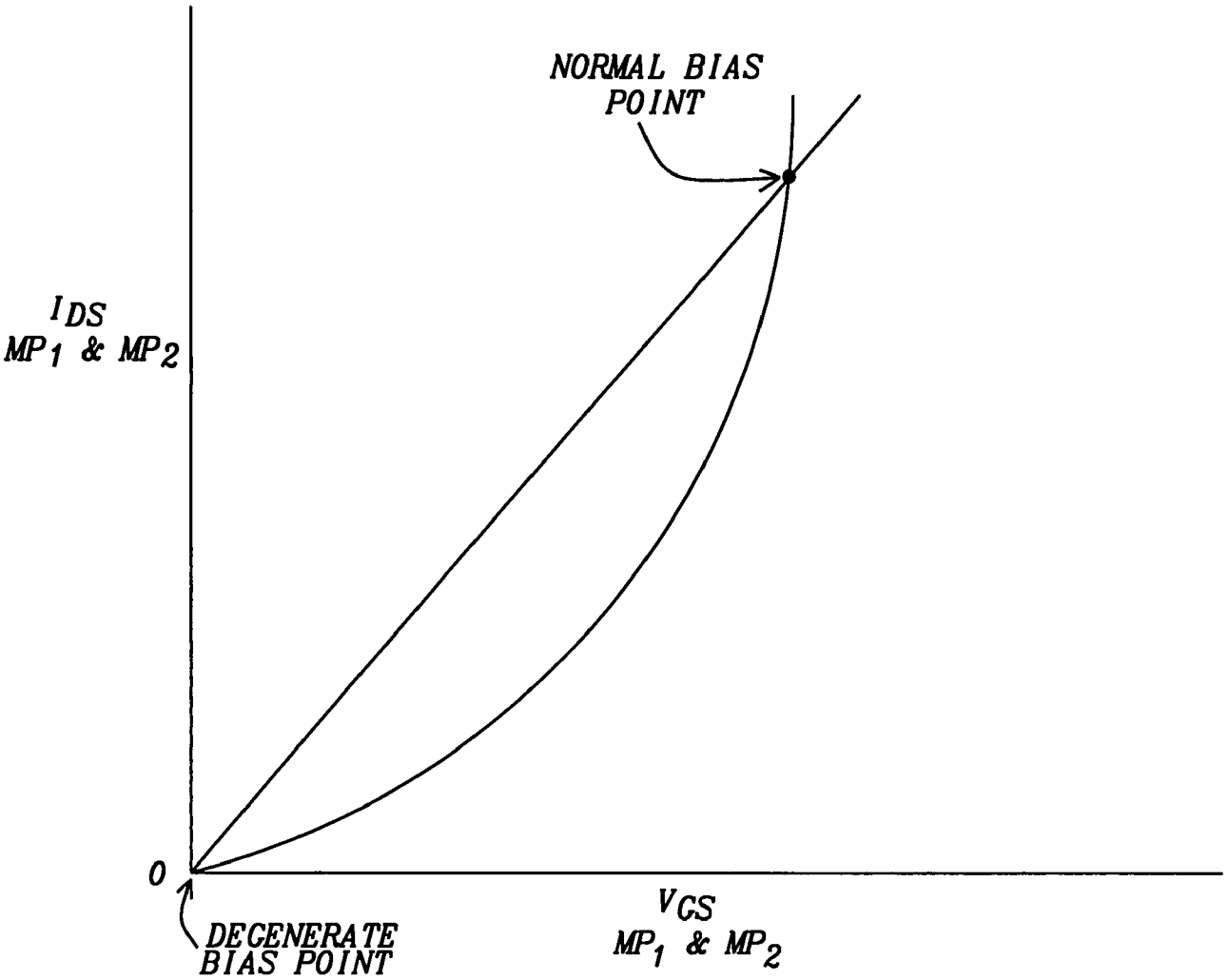
FIG. 2 – Prior Art

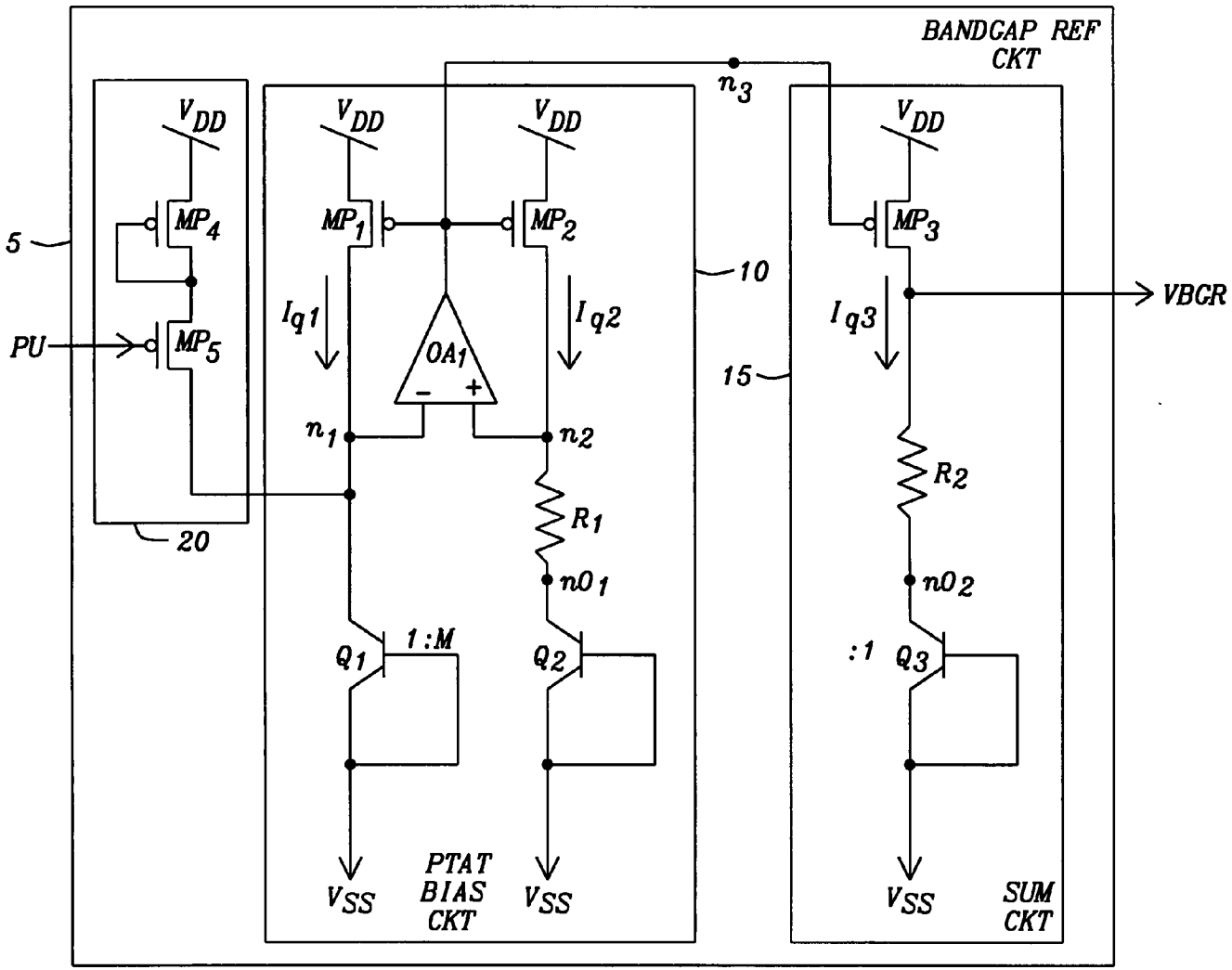
FIG. 3 – Prior Art

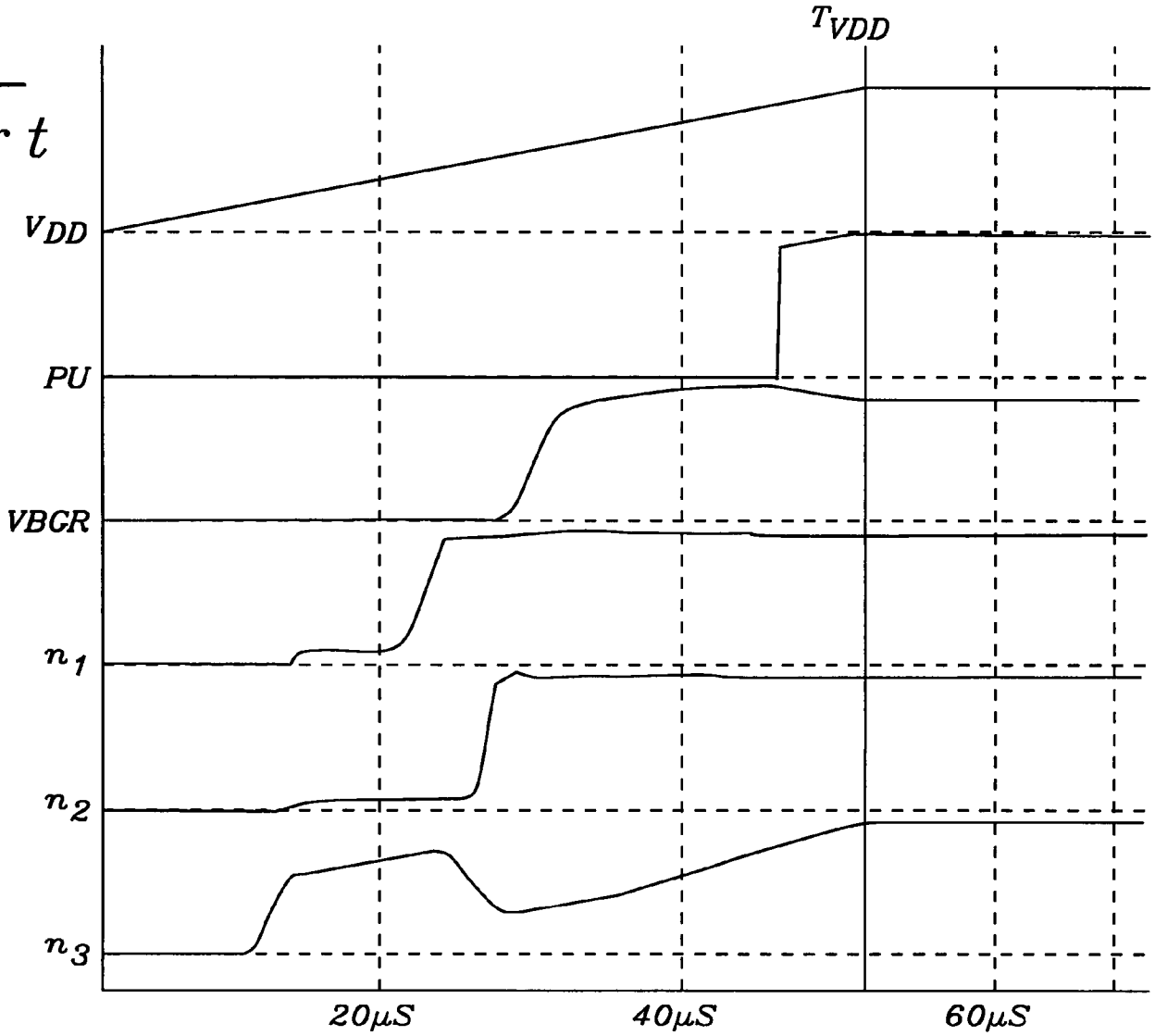
FIG. 4 – Prior Art

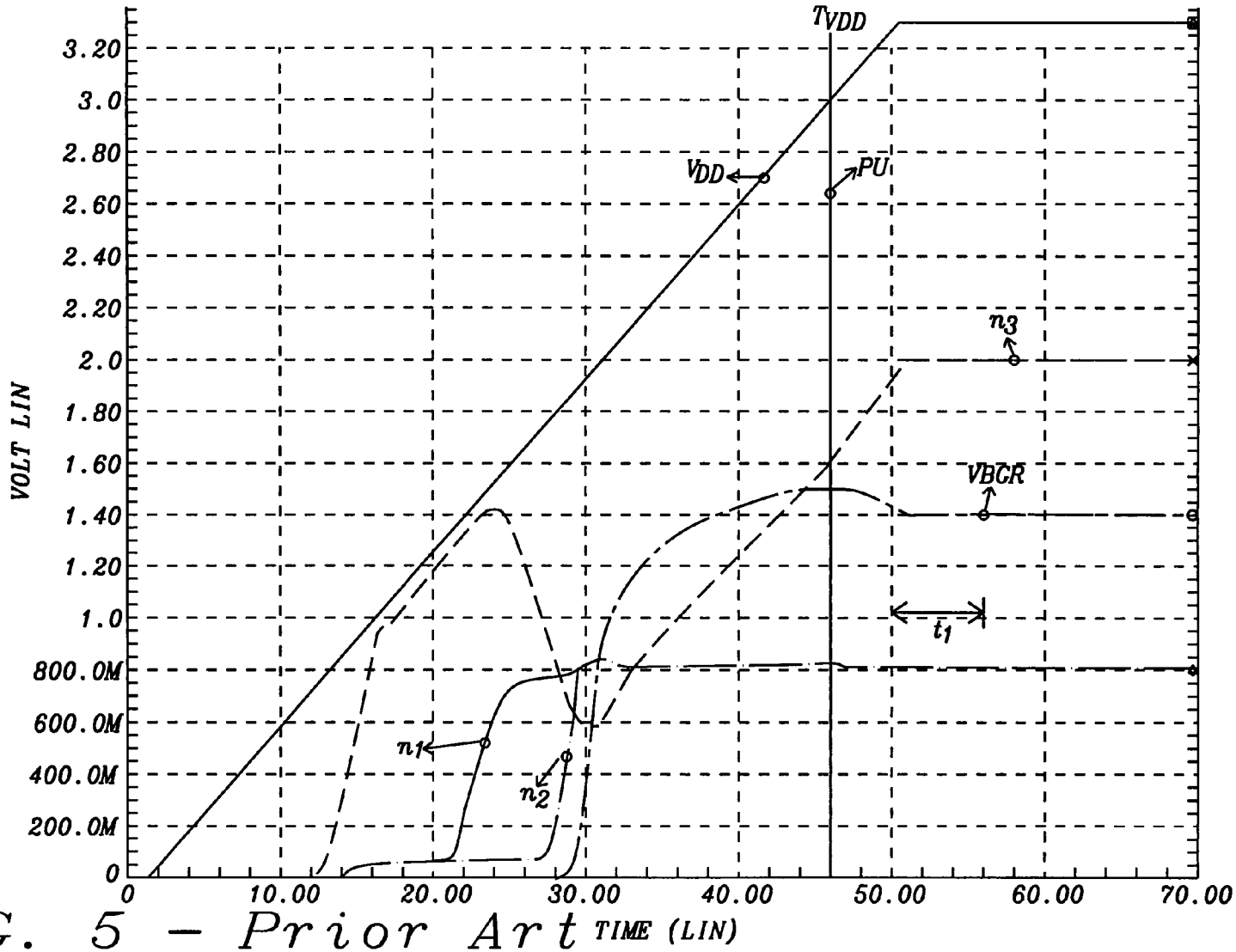
FIG. 5 – Prior Art

SPEED-UP CIRCUIT FOR INITIATION OF PROPORTIONAL TO ABSOLUTE TEMPERATURE BIASING CIRCUITS

BACKGROUND OF THE INVENTION

1. Field of the Invention

This invention relates generally to a reference biasing voltage circuits. More particularly, this invention relates to PTAT (proportional to absolute temperature) biasing circuit and to bandgap voltage reference circuits incorporating a PTAT biasing circuit. Even more particularly, this invention relates to start circuitry for the initiation of PTAT (proportional to absolute temperature) biasing circuits.

2. Description of Related Art

The design of a bandgap referenced voltage source circuits is well known in the art. These circuits are designed to provide a voltage reference that is independent of changes in temperature of the circuit.

The reference voltage of a bandgap referenced voltage source is a function of the voltage developed between the base and emitter $V_{be}$ of a one bipolar junction transistor (bipolar transistor) and the difference between of the base-emitter voltage $V_{be}$ of two other bipolar transistors ($\Delta V_{be}$). The base-emitter voltage $V_{be}$ of the first bipolar transistor has a negative temperature coefficient or the change in the base-emitter voltage $V_{be}$ will be decrease as the temperature increases. The differential voltage of the two other bipolar transistors $\Delta V_{be}$ will have a positive temperature coefficient, which means that the differential base-emitter voltage $\Delta V_{be}$ will increase as the temperature increases. The reference voltage of the temperature independent bandgap voltage referenced voltage source is adjusted by scaling the differential base-emitter voltage $\Delta V_{be}$ and summing it with the base-emitter voltage $V_{be}$ of the first bipolar transistor.

Referring now to FIG. 1 to understand an implementation of a bandgap referenced voltage source circuit 5 of prior art as described in *Design of Analog Integrated Circuits*, Razavi, 2001, McGraw-Hill, New York, N.Y., pp.: 377–381. A PTAT (proportional to absolute temperature) biasing circuit 10 provides a PTAT biasing voltage at the node $n_3$ which is added in the CTAT (complementary to absolute temperature) voltage of a base-emitter voltage Vbe of the first bipolar transistor to generate the bandgap referenced voltage VBGR.

The PTAT biasing circuit 10 includes a pair of diode connected PNP bipolar transistors $Q_1$ and $Q_2$. The bases and collectors of the PNP bipolar transistors $Q_1$ and $Q_2$ are connected to the substrate biasing voltage source $V_{ss}$. The emitter of the PNP bipolar transistor $Q_1$ is connected to the drain of a p-type Metal Oxide Semiconductor (MOS) transistor $MP_1$. The source of the MOS transistor $MP_1$ is connected to the power supply voltage source $V_{DD}$. The emitter of the PNP bipolar transistor $Q_2$ is connected to a bottom terminal of a resistor $R_1$. The top terminal of the resistor $R_1$ is connected to a drain of the p-type MOS transistor $MP_2$. The source of the MOS transistor $MP_2$ is connected to the power supply voltage source $V_{DD}$.

The gates of the MOS transistors $MP_1$ and $MP_2$ are commonly connected to the output of the operational amplifier $OA_1$ and form the node $n_3$ that provides the PTAT biasing voltage. The inverting input (−) of the operational amplifier $OA_1$ is connected to the connection of the drain of the MOS transistor $MP_1$ and the emitter of the PNP bipolar transistor $Q_1$. The noninverting input (+) of the operational amplifier $OA_1$ is connected to the connection of the top terminal of the resistor $R_1$ and the drain of the MOS transistor $MP_2$.

The MOS transistors $MP_1$ and $MP_2$ form current mirrors to generate the currents $I_{q1}$ and $I_{q2}$ that are the emitter currents of the diode connected PNP bipolar transistors $Q_1$ and $Q_2$. The MOS transistors $MP_1$ and $MP_2$ are equal in size such that the currents $I_{q1}$ and $I_{q2}$ are equal. Since the diode connected PNP bipolar transistors $Q_1$ and $Q_2$ are scaled such that the size of the diode connected PNP bipolar transistors $Q_1$ and $Q_2$ have a ratio respectively of 1:M. M is a scaling factor used to determine the PTAT biasing voltage. Thus it can be shown that the current $I_{q2}$ is determined by the equation:

$$I_{q2}=(kT/q)*(In(M)/R_1)$$

where k is Boltzman's constant.

T is absolute temperature.

q is the charge of an electron.

M is the scaling factor of the diode connected PNP bipolar transistors $Q_1$ and $Q_2$.

$R_1$ is the resistance of the resistor $R_1$.

The difference in voltages present at the nodes $n_1$ and $n_2$ are equal to the differential base-emitter voltage ($\Delta V_{be}$) between the base-emitter voltage $V_{be}$ diode connected PNP bipolar transistors $Q_1$ and $Q_2$. The differential base-emitter voltage $\Delta V_{be}$ is amplified by the operational amplifier $OA_1$ to generate the PTAT biasing voltage.

The PTAT biasing voltage is the input to the summing circuit 15 that effectively adds the PTAT biasing voltage with a base-emitter $V_{be}$ voltage of a diode connected PNP bipolar transistor. The summing circuit 15 includes the diode connected PNP bipolar transistor $Q_3$. The base and collector of the diode connected PNP bipolar transistor $Q_3$ is connected to the substrate biasing voltage source $V_{ss}$. The emitter of the diode connected PNP bipolar transistor $Q_3$ is connected to the bottom terminal of the resistor $R_2$. The top terminal of the resistor $R_2$ is connected to the drain of the MOS transistor $MP_3$ that forms a current mirror with the MOS transistors $MP_1$ and $MP_2$ of the PTAT biasing circuit 10. The source of the MOS transistor $MP_3$ is connected to the power supply voltage source $V_{DD}$. The gate of the MOS transistor $MP_3$ is connected to receive the PTAT biasing voltage from the PTAT biasing circuit 10. The current $I_{q3}$ is forced to be equal to the currents $I_{q1}$ and $I_{q2}$. It can be shown that the bandgap referenced voltage VBGR is determined by the equation:

$$VBGR=V_{be3}+(kT/q)*(In(M)*R_2/R_1)$$

where $V_{be3}$ is the voltage developed between the base and the emitter of the diode connected PNP bipolar transistor $Q_3$.

k is Boltzman's constant.

T is absolute temperature.

q is the charge of an electron.

M is the scaling factor of the diode connected PNP bipolar transistors $Q_1$ and $Q_2$.

$R_1$ is the resistance of the resistor $R_1$.

$R_2$ is the resistance of the resistor $R_2$.

It is known that the voltage $V_{be3}$ developed between the base and the emitter of the diode connected PNP bipolar transistor $Q_3$ has a negative temperature coefficient and the PTAT biasing voltage has a positive temperature coefficient from the kT/q, commonly referred as the voltage equivalent of temperature.

It is further known that the voltage $V_{be3}$ developed between the base and the emitter of the diode connected PNP bipolar transistor $Q_3$ varies with temperature at a rate of −1.5 mV/° K. The voltage equivalent of temperature (kT/q) varies with temperature at a rate of +0.087 mV/° K. The scaling factor (M) and the resistance of the resistors $R_1$ and $R_2$ is then chosen such that the temperature coefficient of the bandgap referenced voltage source circuit 5 is essentially zero.

When the power supply voltage source $V_{DD}$ is deactivated the gate to source voltages of the MOS transistors $MP_1$ and $MP_2$ and the currents $I_{q1}$ and $I_{q2}$ are zero. When the power supply voltage source $V_{DD}$ is activated, the MOS transistors $MP_1$ and $MP_2$ and the node $n_3$ is forced to the level of the power supply voltage source $V_{DD}$. This forces the MOS transistor $MP_3$ and thus the current $I_{q3}$ to be zero. This is a degenerate bias point causing a malfunction of the bandgap referenced voltage source circuit 5. Referring to FIG. 2, the desired normal operating point occurs when the drain currents $I_{DS}$ of the MOS transistors $MP_1$ and $MP_2$ and the gate to source voltages $V_{GS}$ to be non-zero. The degenerate operating point as explained above occurs when the drain currents $I_{DS}$ of the MOS transistors $MP_1$ and $MP_2$ and the gate to source voltages $V_{GS}$ are zero.

A solution of this problem is the addition of a start-up circuit 20 as shown in FIG. 3. The start-up sub-circuit 20 has a diode connected MOS transistor $MP_4$. The drain and source of the MOS transistor $MP_4$ are commonly connected to form the cathode of the diode. The anode of the diode is the source of the MOS transistor $MP_4$ connected to the power supply voltage source. The start-up circuit 20 has a MOS transistor $MP_5$ that has is source connected to the gate and drain of the diode connected MOS transistor $MP_4$. The drain of the MOS transistor $MP_5$ is connected to the node $n_1$ of the PTAT biasing circuit 10. The gate of the MOS transistor $MP_5$ is connected to a power-up indication signal PU. The power-up indication signal PU is activated when the power supply voltage source $V_{DD}$ has reached a threshold level after the power supply voltage source $V_{DD}$ has been made active. Prior to the activation of the power-up indication signal PU, the drain of the MOS transistor $MP_5$ is at approximately the voltage level of the power supply voltage source $V_{DD}$ less the voltage drop accross of the of the diode connected MOS transistor $MP_4$. This causes the voltage at the node $n_1$ to be non-zero and thus the gate to source voltage of the MOS transistor $MP_1$ to be non-zero allowing the node $n_3$ to become the PTAT biasing voltage and the normal bias point of FIG. 2.

FIGS. 4 and 5 shows plots of the voltages showing the operation conditions of the bandgap referenced voltage source circuit 5. When the voltage of the power supply voltage source $V_{DD}$ begins to rise upon activation, the voltage at the node $n_1$ becomes non-zero since the MOS transistor $MP_5$ is turned on. This causes the node $n_3$ to increase dramatically causing the node $n_2$ to become non-zero. This forces the bandgap referenced voltage VBGR to rise, but not to the steady state controlled voltage. The voltage at the node $n_1$ is not set to the base-emitter voltage of the diode connected PNP bipolar transistor $Q_1$ as long as the start-up sub-circuit 20 is active. When the power-up indication signal PU has reached the threshold (generally about 90% of the power supply voltage source $V_{DD}$), the nodes $n_1$, $n_2$, and $n_3$ reach their steady state values and the bandgap referenced voltage VBGR reaches its steady state voltage. Referring to FIG. 5, having to wait for the power-up indication signal PU to activate causes a delay $t_1$ in the time when the bandgap referenced voltage source circuit 5 is providing the bandgap reference voltage VBGR.

"A Bandgap Voltage Reference Using Digital CMOS Process" Vermaas et al., Proceedings—1998 IEEE International Conference on Electronics, Circuits and Systems, 1998, pp.: 303–306 vol. 2 describes some issues and criteria for the design of a bandgap voltage reference. In particular voltage reference architecture, characteristics of the operational amplifier, parasitic bipolar transistor biasing currents and the start-up sub-circuit are described.

"The Design of Band-Gap Reference Circuits: Trials and Tribulations" Pease, Proceedings of the 1990 Bipolar Circuits and Technology Meeting, 1990, pp.: 214–218 is tutorial that discusses the designs of various band-gap references, particularly, start-up circuits.

U.S. Pat. No. 4,839,535 (Miller) discusses a bandgap voltage reference. The reference is generated by a MOS current source sourcing current to two substrate bipolar transistors operating at different current densities and operated as emitter followers. A pair of MOS current mirrors sink current from the two bipolar transistors. A start-up circuit initializes the circuit upon application of supply voltages. An output stage multiplies the bandgap reference voltage to the desired output voltage level. A feedback stage improves the accuracy of the output voltage by adjusting the current in the reference circuit.

U.S. Pat. No. 5,087,830 (Cave, et al.) describes a start-up circuit for a bandgap reference cell using CMOS transistors including a transistor connected between the bandgap reference cell and a differential amplifier in the feedback path. The transistor creates an offset voltage in the bandgap reference cell when power is first applied. The offset insures the correct operation of the bandgap reference cell, and to turn off after correct operation has been achieved.

U.S. Pat. No. 5,545,978 (Pontius) teaches a bandgap reference generator having regulation and kick-start circuits. The bandgap reference generator includes a bandgap reference circuit and a voltage regulation circuit coupled to bandgap reference circuit. The voltage regulation circuit operates to supply power to the bandgap reference circuit such that the voltages at a first internal control node and a second internal control node are equal. Kick-start circuits for the voltage regulation circuit and the bandgap reference circuit are also included within the bandgap reference generator.

U.S. Pat. No. 5,610,506 (McIntyre) provides a bandgap reference circuit which generates a reference voltage which is always at least as high as a stable reference value. This is done by generating a lock signal which is maintained at a first logic level during start-up of the reference circuit and then attains a second logic level when the reference value has stabilized.

U.S. Pat. No. 6,084,388 (Toosky) describes a low power start-up circuit for bandgap voltage reference. The start-up circuit may achieve lower current requirements by reducing the current of the start-up circuit to approximately zero when the bandgap circuit reaches a predetermined value.

U.S. Pat. No. 6,133,719 (Maulik) provides a start-up circuit for a bandgap reference. An amplifier is configured in a differential arrangement as the bandgap reference. A start-up circuitry ensures that a second input node is maintained at a lower voltage than a first input node of the amplifier at start-up, when the output node corresponding to the second input side of the amplifier is also pulled low.

U.S. Pat. No. 6,335,614 (Ganti) teaches a bandgap reference voltage circuit with a start-up circuit that initiates operation of a bandgap reference circuit. The start pulse circuit provides a start pulse when the bandgap circuit is powered up. A transistor receives the pulse as an input, and applies the pulse to a regenerative bandgap reference circuit. The bandgap reference circuit output voltage is forced above a normal output voltage, producing a feedback current through the bandgap reference circuit, providing a current level which exceeds the normal stable operating level and output voltage level range. When the pulse ceases, the regenerative bandgap reference circuit output voltage decreases to its normal stable value, and the regenerative bandgap reference circuit is placed in its normal stable operating state.

U.S. Pat. No. 6,392,470 (Burstein, et al.) describes a bandgap reference transitioning circuit. The bandgap reference transitioning circuit includes a supply-independent biasing circuit that is electrically connected to a start-up circuit and supports the start-up circuit's ability to cause a bandgap reference circuit to transition to its operational mode for any supply voltage that supports the bandgap reference circuit's operational mode.

U.S. Pat. No. 6,509,726 (Roh) provides an amplifier for a bandgap reference circuit having a built-in start-up circuit. The bandgap reference circuit includes at least one transistor, an amplifier and a start-up circuit. The amplifier is coupled to the transistor(s) to establish a bandgap reference voltage. The start-up circuit, in response to the bandgap reference circuit powering up, isolates an output terminal of the amplifier from at least one input terminal of the amplifier and supplies power to the transistor(s) via the output terminal.

U.S. Pat. No. 6,566,850 (Heinrich) illustrates a low-voltage, low-power bandgap reference circuit with bootstrap current. The bandgap reference generator includes a bandgap reference circuit, a sensing circuit, and a current injector circuit. The sensing circuit is coupled to the bandgap reference circuit for sensing a first voltage at a first internal node of the bandgap reference circuit. The current injection circuit is responsive to the sensing circuit for injecting bootstrap current into a second internal node until the first voltage reaches a threshold voltage. The current injection circuit is operative to inject the bootstrap current into the second internal node during an initial condition of the bandgap reference circuit to cause the bandgap reference circuit to quickly transition to a desired operating state. The injection of bootstrap current is discontinued when the second voltage reaches the threshold voltage reflecting that the desired operating state is achieved.

U.S. Pat. No. 6,642,776 (Micheloni, et al.) describes a bandgap voltage reference circuit. The bandgap voltage reference circuit includes a low power consumption bandgap circuit and short start-up time a bandgap circuit. The short start-up time bandgap circuit supplies the output reference voltage until the low power consumption bandgap circuit until it becomes stabilized at which time the short start-up time bandgap circuit is turned off.

U.S. Pat. No. 6,710,641 (Yu, et al.) describes a bandgap reference circuit that operates with a voltage supply that can be less than 1 volt and that has one stable, non-zero current operating point. The core has a current generator embedded within it and includes one operational amplifier that provides a self-regulated voltage for several transistors used in the circuit.

U.S. Pat. No. 6,737,908 (Mottola, et al.) teaches a bootstrap reference circuit including a shunt bandgap regulator with external start-up current source. The bootstrap reference circuit includes a shunt regulator for generating a reference voltage at a first node, a current source generating a current, and a current mirror coupling the current to the shunt regulator for supplying the shunt regulator. In operation, when the shunt regulator is powering up, the current has an increasing magnitude when a voltage at the first node is less than a predefined voltage value where the predefined voltage value is less than the reference voltage.

U.S. Patent Application 2002/0125937 Park, et al. illustrates a bandgap reference voltage circuit having a bandgap start-up circuit for initiating operation of the bandgap reference voltage circuit. The bandgap start-up circuit is connected to a low impedance leg in the bandgap core circuit and the bandgap output circuit has a feedback circuit that is connected to a high impedance leg in the bandgap core circuit. The connection of the bandgap start-up circuit to the low impedance leg of the bandgap core circuit eliminates the possibility of metastable operation of the bandgap reference voltage circuit.

U.S. Patent Application 2003/0080806 (Sugimura) provides a bandgap reference voltage circuit. The bandgap voltage circuit includes a constant-current circuit, a reference voltage output circuit that generates a reference voltage according to the constant current, a power supply voltage detection circuit, and a start-up output circuit. The start-up output circuit supplies a starting potential to a node in the constant-current circuit until the power supply voltage detection circuit detects that the power supply has reached a voltage sufficient for the constant-current circuit to maintain operation.

U.S. Patent Application 2003/0201822 (Kang, et al.) describes a fast start-up low-voltage bandgap voltage reference circuit. The fast start-up low-voltage bandgap voltage reference circuit optionally has a starting circuit added to the bandgap voltage reference circuit to increase the steadiness when starting.

SUMMARY OF THE INVENTION

An object of this invention is to provide a startup circuit to initiate a PTAT (Proportional To Absolute Temperature) biasing circuit that detects the state of the startup circuit to terminate the initiation process.

Another object of this invention is to provide a PTAT biasing circuit that includes a startup sub-circuit that forces the PTAT biasing from a degenerate operating point to a normal operating point and upon detection of the initiation of the PTAT biasing circuit terminates operation of the startup sub-circuit.

Further, another object of this invention is to provide a bandgap reference circuit that includes a startup sub-circuit that forces the bandgap reference circuit from a degenerate operating point to a normal operating point and upon detection of the initiation of the bandgap reference terminates operation of the startup sub-circuit.

To accomplish at least one of these objects, a bandgap reference circuit for generation of a bandgap referenced voltage includes a PTAT biasing circuit for generating a PTAT biasing voltage, a speed up circuit for initiation of the bandgap reference circuit, and a bandgap summing circuit for effectively adding the PTAT biasing voltage and a CTAT (Complementary To Absolute Temperature) voltage to generate a bandgap referenced voltage.

The speed up circuit incorporates a first MOS transistor of a first conductivity type and a first and second MOS transistor of a second conductivity type. The MOS transistor of the first conductivity type has a source connected to a first power supply voltage source, a gate connected to receive a power indication signal, and a drain. The first MOS transistor of a second conductivity type has a drain connected to receive a PTAT biasing voltage from the PTAT biasing circuit, a gate in communication with the drain of the MOS transistor of the first conductivity type, and a source connected a second power supply voltage source. The second MOS transistor of the second conductivity type has a drain in communication with the drain of the MOS transistor of the first conductivity type and the gate of the first MOS transistor of the second conductivity type, a gate connected to receive a feedback signal from the PTAT biasing circuit, and a source connected to the second power supply voltage source.

If the power indication signal denotes that the first power supply has not achieved a threshold level during activation of the first power supply, the drain of the MOS transistor of the first conductivity type is at a first voltage level to activate the first MOS transistor of the second conductivity to force the PTAT biasing voltage to a voltage level of the second power supply voltage source. When the feedback signal indicates that the PTAT biasing circuit has achieved a normal biasing voltage level, the second MOS transistor of the second conductivity type is activated and the first MOS transistor of the second conductivity type is deactivated and the PTAT biasing voltage is set to an active biasing level.

The PTAT biasing generation circuit in communication with the start up circuit to provide the PTAT biasing voltage and the feedback signal to the start up circuit. The PTAT biasing generation circuit includes a first and second diode connected bipolar transistor and a second and third MOS transistor of the first conductivity type. The first diode connected bipolar transistor has a base and collector commonly connected to the second power supply voltage source, and an emitter. The second diode connected bipolar transistor has a base and collector commonly connected to the second power supply voltage source, and an emitter. The second MOS transistor of the first conductivity type has a source connected to the first power supply voltage source, a gate, and a drain in communication with the emitter of the first diode connected bipolar transistor to provide a first current to the first diode connected bipolar transistor. The third MOS transistor of the first conductivity type has a source connected to the first power supply voltage source, a gate, and a drain in communication with the emitter of the second diode connected bipolar transistor to provide a second current to the first diode connected bipolar transistor. The PTAT biasing generation circuit further includes a first resistor and an operation amplifier. The first resistor has a first terminal connected to receive the second current from the drain of the third MOS transistor of the first conductivity type and a second terminal connected to transfer the second current to the emitter of the second diode connected bipolar transistor to develop a difference base emitter voltage indicating a disparity in a base-emitter voltage of the first diode connected bipolar transistor and a base emitter-voltage the second diode connected bipolar transistor. The operational amplifier has inputs connected to receive and amplify the base-emitter voltage of the first diode connected bipolar transistor and a base-emitter voltage of the second diode connected bipolar transistor to generate the PTAT biasing voltage.

The feedback signal provided to the speed up circuit is the base-emitter voltage of the first diode connected bipolar transistor in a first implementation. Alternately, the feedback signal is the base emitter-voltage the second diode connected bipolar transistor in a second implementation.

In a third implementation the PTAT biasing generation circuit further includes a second resistor. The second resistor has a first terminal connected to receive the first current and a second terminal to transfer the second current to the emitter of the first diode connected bipolar transistor. The feedback signal is, in the third implementation, generated at the first terminal of the second resistor.

In a fourth implementation the PTAT biasing generation circuit includes a third resistor. The third resistor has a first terminal connected to receive the second current and a second terminal to transfer the second current to the first terminal of the first resistor and thence to the emitter of the first diode connected bipolar transistor. The feedback signal is generated, in the fourth implementation, at the first terminal of the third resistor.

The bandgap summing circuit sums the PTAT biasing voltage with a bipolar transistor base emitter voltage to generate the bandgap referenced voltage. The bandgap summing circuit incorporates a fourth MOS transistor of the first conductivity type, a fourth resistor, and third diode connected bipolar transistor. The fourth MOS transistor of the first conductivity type has a source connected to the first power supply voltage source, a gate connected to receive the PTAT biasing voltage, and a drain. The fourth resistor has a first terminal connected to receive a third current transferred from the drain of the fourth MOS transistor of the first conductivity type, and a second terminal to transfer the third current. The third diode connected bipolar transistor has a base and collector commonly connected to the second power supply voltage source and an emitter connected to receive the third current from the second terminal of the fourth resistor. The bandgap reference voltage is generated at the second terminal of the fourth resistor. In a fifth implementation, the feedback signal for the speed up circuit is the bandgap reference voltage.

BRIEF DESCRIPTION OF THE DRAWINGS

FIG. 1 is a schematic diagram of a bandgap referenced voltage source of the prior art.

FIG. 2 is a plot of the operation the MOS transistors of the PTAT biasing circuit of the prior art illustrating the operating points of the circuit FIG. 3 is a schematic diagram of a bandgap referenced voltage source with a startup circuit of the prior art.

FIGS. 4 and 5 are plots of the operation voltages versus time of the bandgap referenced voltage source of the prior art of FIG. 3.

DETAILED DESCRIPTION OF THE INVENTION

The speedup circuit of this invention initiates the action of a PTAT biasing circuit. When the PTAT biasing circuit has activated, the speedup circuit senses the activation and is disengaged. A power up signal is applied to the speedup circuit to provide an indication that a power supply voltage source has achieved a threshold level. A feedback signal is received by the speedup circuit indicating that the operation of the PTAT biasing circuit has departed from the degenerate operation point. When the feedback signal indicates the departure from the degenerate operation point, the speedup circuit is automatically disabled.

Figure 6A:
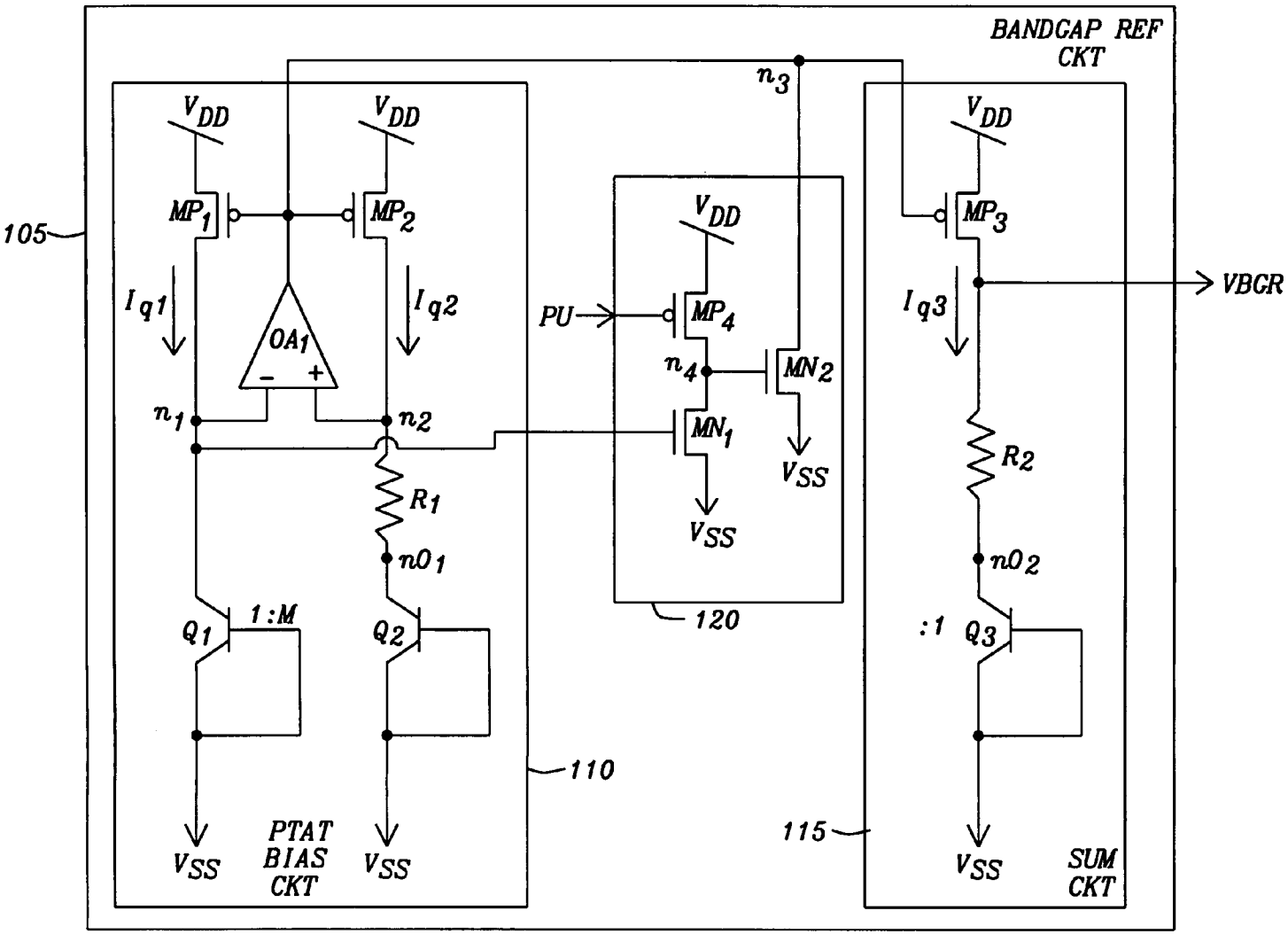
FIGS. 6*a* and 6*b* are schematics of a first and second embodiment of a bandgap referenced voltage source with a speedup circuit of this invention.

Refer to FIG. 6*a* for a description of a bandgap referenced voltage source 105. The PTAT biasing circuit 110 is structured and operates as the PTAT biasing circuit 10 of FIG. 1. The speedup circuit of this invention 120 is connected to receive the power-up signal PU that indicates the operation state of the power supply voltage source $V_{DD}$. When the power-up signals PU is activated, the power supply voltage source $V_{DD}$ has achieved a threshold value that is proportional to the operating voltage of the power supply voltage source $V_{DD}$. During the period that the power-up signal PU is deactivated, the speedup circuit 120 is activated.

The output of the speedup circuit 120 is connected to the PTAT voltage at node $n_3$. While the speedup circuit 120 is activated, the node $n_3$ is discharged to the substrate voltage reference source $V_{ss}$. When the feedback signal from the PTAT biasing 110 is activated, the speedup circuit 120 is disabled and the node n3 becomes set to the PTAT biasing voltage. In this first embodiment, the feedback signal is the base-emitter voltage of the first diode connected bipolar transistor $Q_1$ of the PTAT biasing circuit 110.

The speedup circuit 120 has a p-type MOS transistor $MP_4$ with a source connected to the power supply voltage source $V_{DD}$. The gate is connected to receive the power up signal PU. The drain of the p-type MOS transistor $MP_4$ is connected to the drain of the n-type MOS transistor $MN_1$ and to the gate of the n-type MOS transistor $MN_2$. The gate of the n-type MOS transistor $MN_1$ is connected to the node $n_1$ of the PTAT biasing circuit 110 to receive the feedback signal. The sources of the n-type MOS transistors $MN_1$ and $MN_2$ are connected to the substrate biasing power supply voltage source $V_{SS}$. The drain of the n-type MOS transistor $MN_2$ is connected to the node $n_3$ to discharge the node $n_3$ during the activation of the power supply voltage source $V_{DD}$ to force the PTAT biasing circuit 110 from its degenerate operating point.

When the feedback signal at the node $n_1$ becomes sufficiently positive, the n-type MOS transistor $MN_1$ turns on. The voltage at the drain of the n-type MOS transistor $MN_1$ approaches the voltage level of the substrate biasing power supply voltage source $V_{SS}$ and the n-type MOS transistor $MN_2$ is turned off to deactivate the speedup circuit 120.

The PTAT biasing voltage is present at the node $n_3$ that is connected to the summing circuit 115. The summing circuit 115 effectively adds the PTAT biasing voltage to the base-emitter voltage of a diode connected bipolar transistor. The summing circuit 115 is formed of the p-type MOS transistor $MP_3$, the resistor $R_2$, and the diode connected PNP bipolar transistor $Q_3$ and functions as the summing circuit 15 of FIG. 1.

Figure 6B:
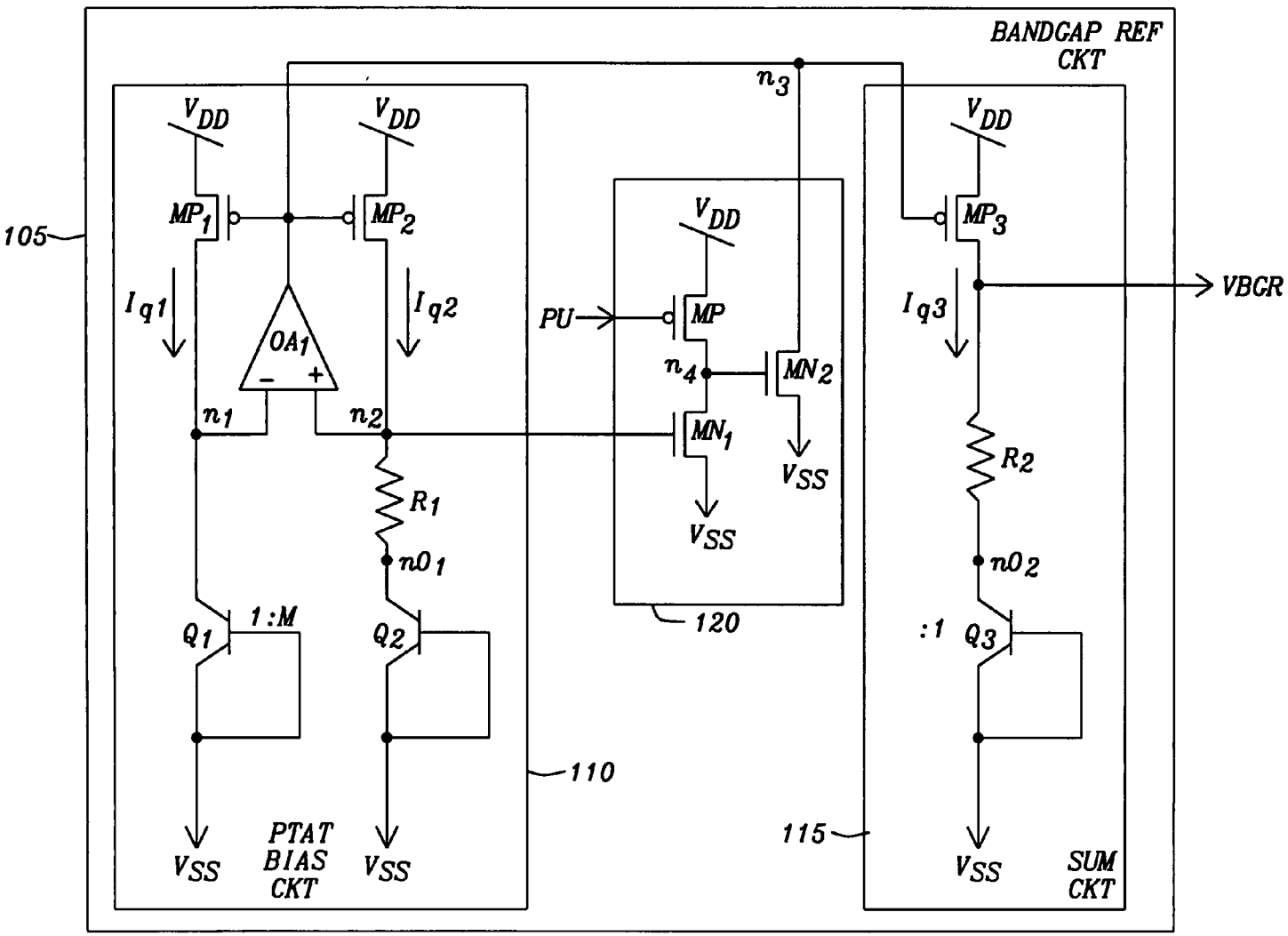

Referring to FIG. 6*b* for the second embodiment of the speedup circuit 120 of this invention. In this embodiment the gate of the n-type MOS transistor $MN_1$ is connected to the node $n_2$ of the PTAT biasing circuit 110. As in the first embodiment, when the voltage present at the node $n_2$ becomes sufficiently positive to turn on the n-type MOS transistor $MN_1$. The n-type MOS transistor $MN_2$ is then turned off and the speedup circuit 120 is deactivated.

Figure 7A:
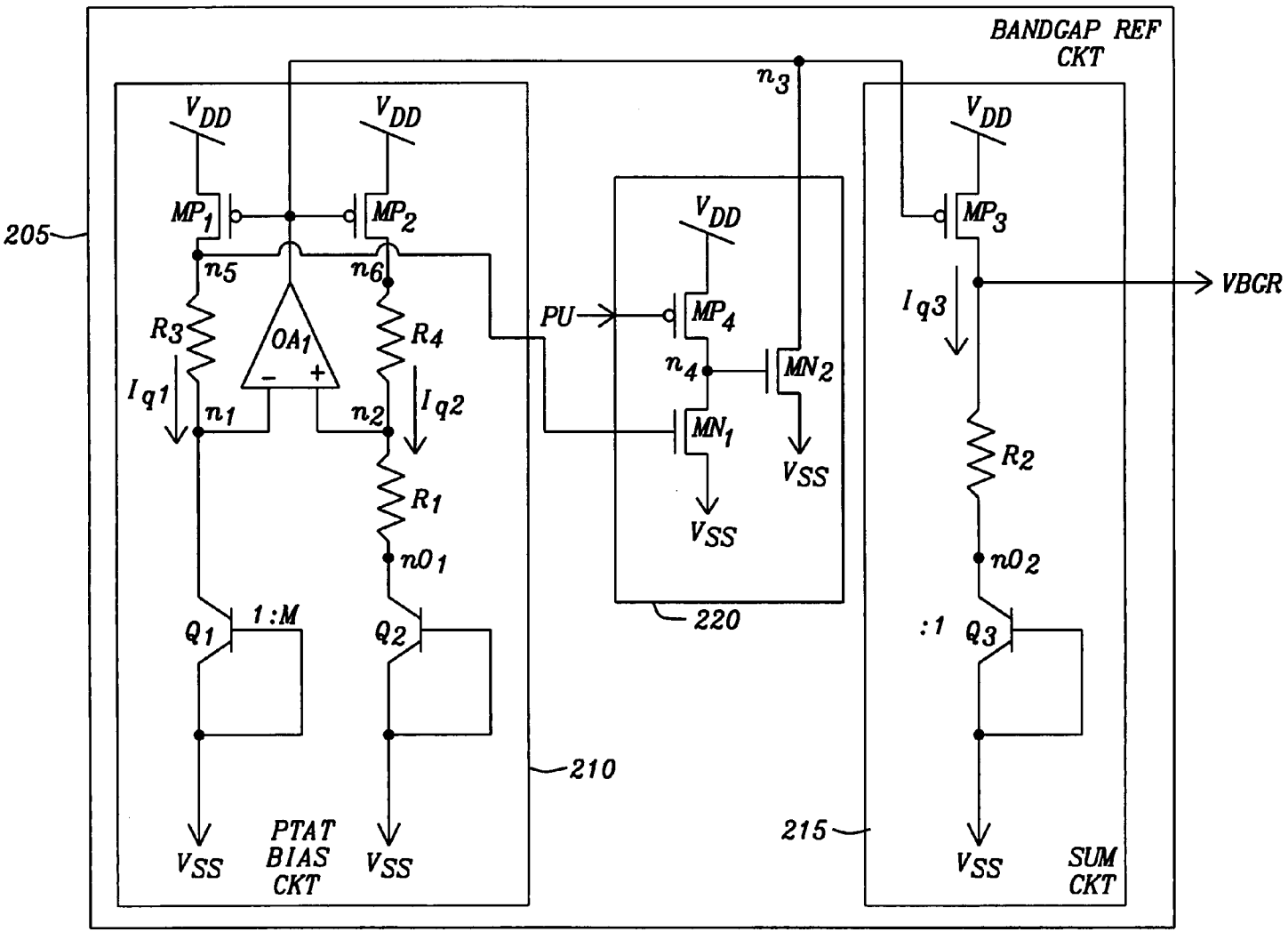
FIGS. 7*a* and 7*b*, are schematics of a third and fourth embodiment of a bandgap referenced voltage source with a speedup circuit of this invention.
Figure 7B:
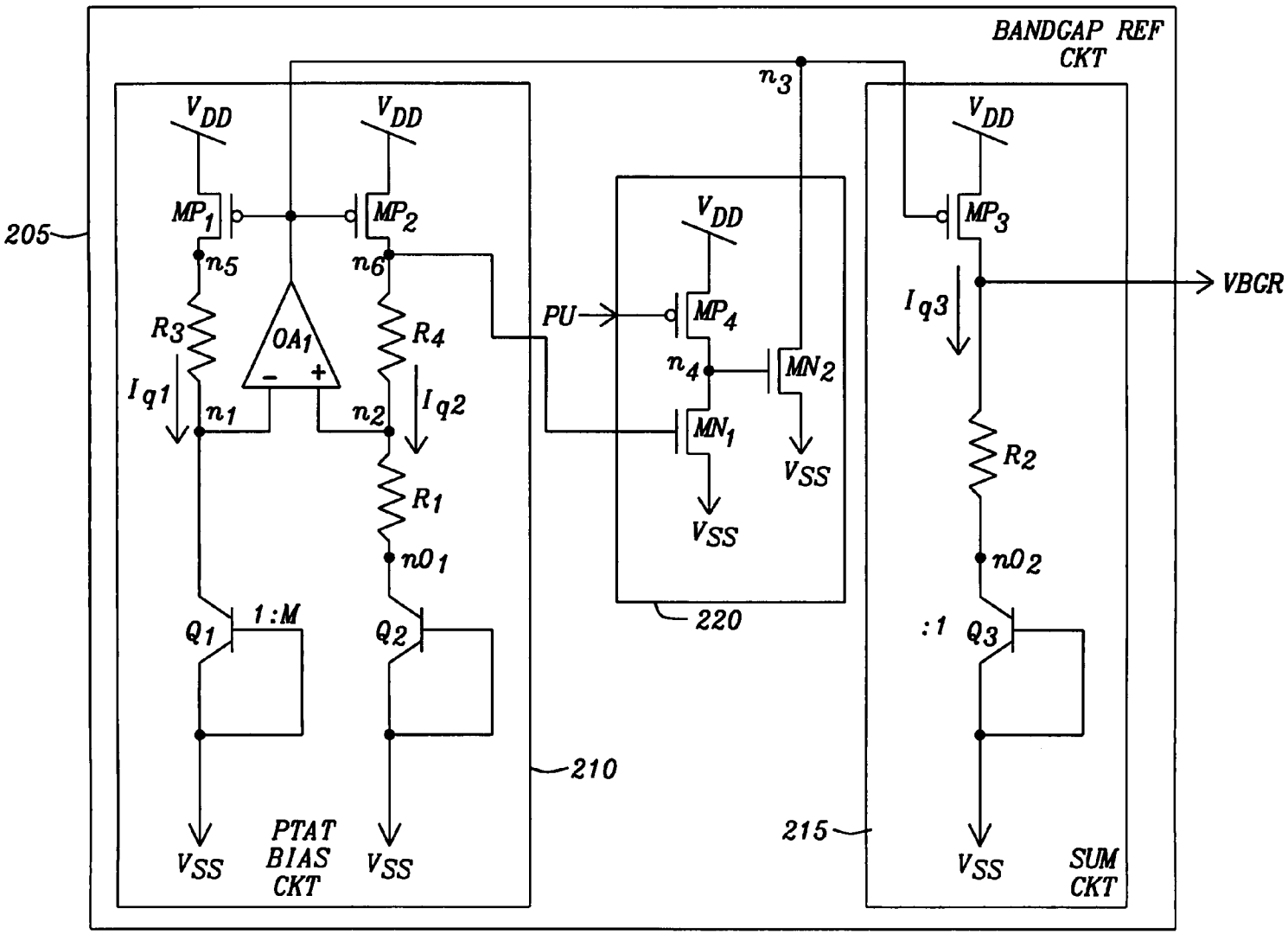

In the third and fourth embodiments of the speedup circuit 220 of this invention as shown in FIGS. 7*a* and 7*b*, the basic structure is essentially similar to the structure of FIGS. 6*a* and 6*b*. The speedup circuit 220 is connected to the node $n_3$ to perform the initiation process of the bandgap referenced voltage source 205. The PTAT biasing circuit 210 provides the PTAT biasing voltage to the node $n_3$ and thus to the summing circuit 215. In the PTAT biasing circuit 210, the resistor $R_3$ is placed between the node $n_5$ at the drain of the p-type MOS transistor $MP_1$ and the node $n_1$ at the emitter of the diode connected PNP bipolar transistor $Q_1$ and the inverting input of the operational amplifier $OA_1$. The resistor $R_4$ is placed between the node $n_6$ at the drain of the p-type MOS transistor $MP_2$ and the node $n_2$ at the emitter of the diode connected PNP bipolar transistor $Q_2$ and the non-inverting input of the operational amplifier $OA_1$. The resistors $R_3$ and $R_4$ have a resistance that is equal to the resistance of the resistor $R_2$. The remaining structure and operation of the PTAT biasing circuit 210 is equivalent to that of the PTAT biasing circuit 10 of FIG. 1.

The feedback signal present at the node $n_1$ in FIG. 6*a* and the node $n_2$ in FIG. 6*b* is strongly dependent upon temperature as shown in the explanation of FIG. 1. This temperature dependence would cause the initiation process of the speed up circuit 120 to either under initiate or over initiate the PTAT biasing voltage circuit 110 and thus the bandgap referenced voltage source 105. This forces the bandgap referenced voltage source 105 to remain unstable for a longer period. This slows the application of the bandgap referenced voltage to external circuitry.

The voltage at the nodes can be shown to be determined by the equations:

$$V_{n5}=V_{be1}+(kT/q)*(In(M)*R_3/R_1)$$

$$V_{n6}=V_{be1}+(kT/q)*(In(M)*R_4/R_1)$$

where $V_{n6}$ is the voltage developed between at the node $n_6$.

$V_{be1}$ is the voltage developed between the base and the emitter of the diode connected PNP bipolar transistor $Q_1$.

k is Boltzman's constant.

T is absolute temperature.

q is the charge of an electron.

M is the scaling factor of the diode connected PNP bipolar transistors $Q_1$ and $Q_2$.

$R_1$ is the resistance of the resistor $R_1$.

$R_2$ is the resistance of the resistor $R_2$.

The feedback signal in FIG. 7*a* is developed at the node $n_5$ and is transferred to the speedup circuit 220 at the gate of the n-type MOS transistor $MN_1$. Alternately, the feedback signal in FIG. 7*b* is developed at the node $n_6$ and is transferred to the speedup circuit 220 at the gate of the n-type MOS transistor $MN_2$. As can be seen by the equations for the voltages $V_{n5}$ and $V_{n6}$, the feedback signal can now be relatively temperature independent.

Figure 8A:
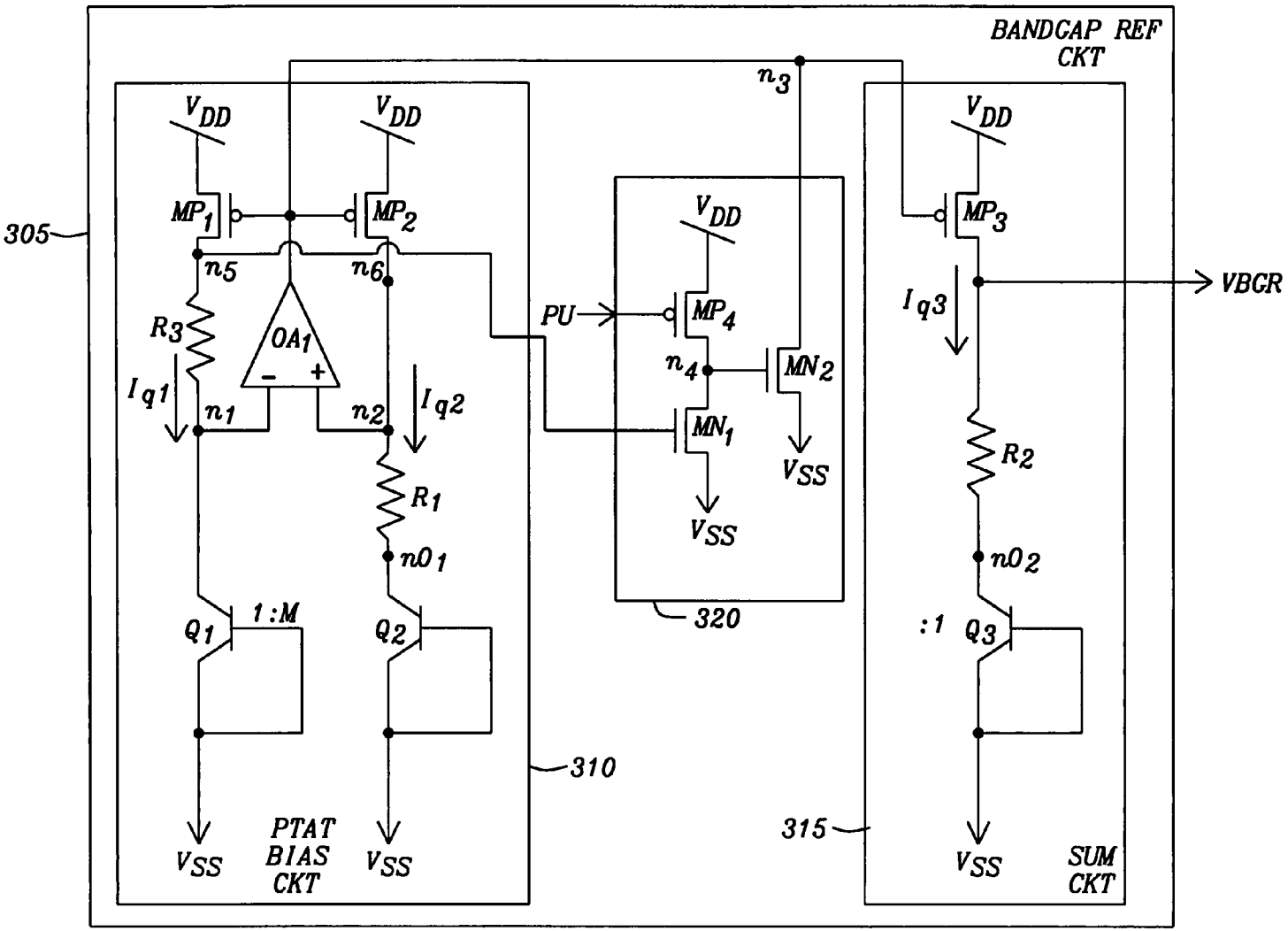
FIGS. 8*a* and 8*b* are schematics of a fifth and sixth embodiment of a bandgap referenced voltage source with a speedup circuit of this invention.
Figure 8B:
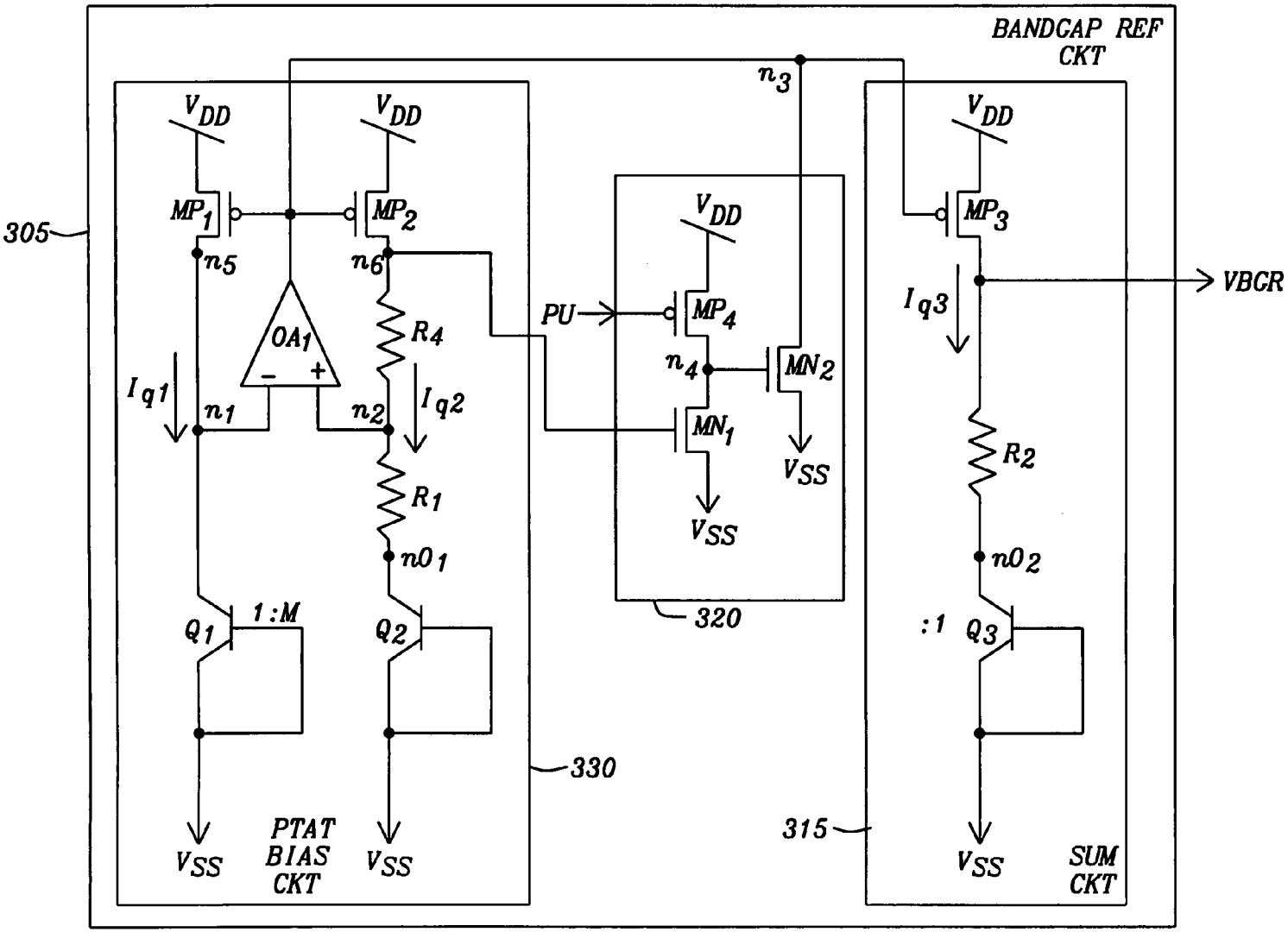

In the fifth and sixth embodiments of the speedup circuit 320 of this invention as shown in FIGS. 8*a* and 8*b*, the basic structure is similarly essentially similar to the structure of FIGS. 6*a* and 6*b*. The speedup circuit 320 is connected to the node $n_3$ to perform the initiation process of the bandgap referenced voltage source 305. The PTAT biasing circuit 310 provides the PTAT biasing voltage to the node $n_3$ and thus to the summing circuit 315. In the PTAT biasing circuit 310 of FIG. 8*a*, the resistor $R_3$ is placed between the node $n_5$ at the drain of the p-type MOS transistor $MP_1$ and the node $n_1$ at the emitter of the diode connected PNP bipolar transistor $Q_1$ and the inverting input of the operational amplifier $OA_1$. In the PTAT biasing circuit 310 of FIG. 8*b*, the resistor $R_4$ is placed between the node $n_6$ at the drain of the p-type MOS transistor $MP_2$ and the node $n_2$ at the emitter of the diode connected PNP bipolar transistor $Q_2$ and the non-inverting input of the operational amplifier $OA_1$. The resistors $R_3$ and $R_4$ have a resistance that is equal to the resistance of the resistor $R_2$. The remaining structure and operation of the PTAT biasing circuit 310 is equivalent to that of the PTAT biasing circuit 10 of FIG. 1.

It can be shown that voltage $V_{n5}$ that is developed between at the node $n_5$ of FIG. 8*a* and the voltage $V_{n6}$ that is developed between at the node $n_6$. of FIG. 8*b* can be derived according to the above equations for FIGS. 7*a* and 7*b*. The embodiments of FIGS. 8*a* and 8*b* are respectively special case of the embodiments of FIGS. 7*a* and 7*b*. The addition of the resistors $R_3$ and $R_4$ respectively to FIGS. 8*a* and 8*b* do not affect the functioning of the bandgap voltage source 305

Figure 9A:
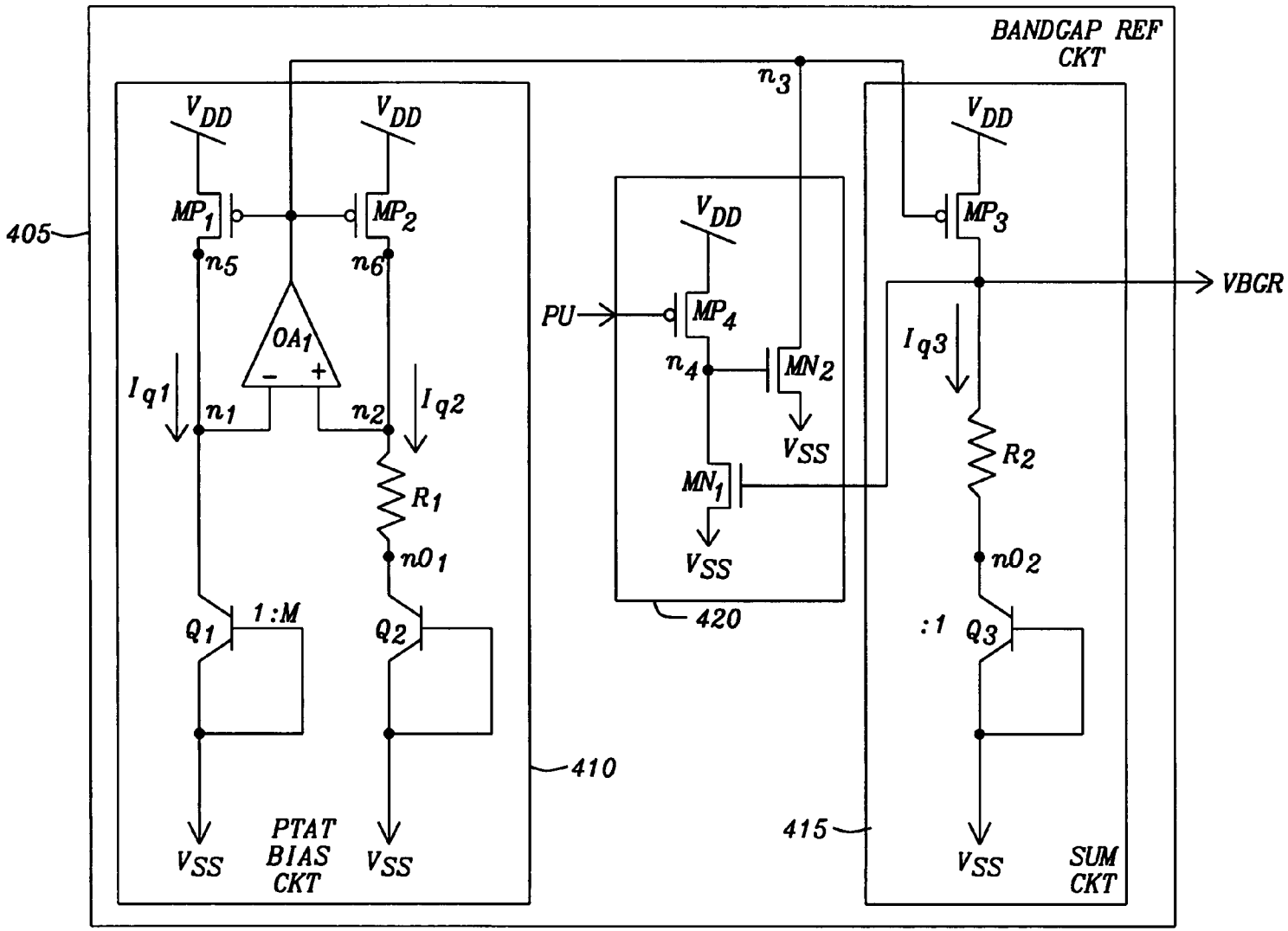
FIGS. 9*a* and 9*b* is a schematic of a seventh and eighth embodiment of a bandgap referenced voltage source with a speedup circuit of this invention.

Referring now to FIG. 9*a* for a discussion of the seventh embodiment of the speedup circuit 420 of this invention, the basic structure is essentially similar to the structure of FIGS. 6*a* and 6*b*. The speedup circuit 420 is connected to the node $n_3$ to perform the initiation process of the bandgap referenced voltage source 405. The PTAT biasing circuit 410 provides the PTAT biasing voltage to the node $n_3$ and thus to the summing circuit 415. The structure and function of the PTAT biasing circuit 410 is identical to that of the PTAT biasing circuit 10 of FIG. 1. In this implementation of the bandgap referenced voltage source 405, the feedback signal is provided to the n-type MOS transistor $MN_1$ from the drain of the p-type MOS transistor $MP_3$ and the top terminal of the resistor $R_2$ from which the bandgap referenced voltage is generated. In this instance, when the p-type MOS transistor $MP_4$ is turned on thus turning on the n-type MOS transistor $MN_2$, the p-type MOS transistor $MP_3$ is turned on and the second terminal of the resistor $R_2$ increases with the voltage level of the power supply voltage source $V_{DD}$. When the level of the bandgap referenced voltage VBGR reaches a voltage level sufficient to turn on the n-type MOS transistor $MN_1$, the n-type MOS transistor $MN_2$ turns off and the PTAT biasing voltage level begins to stabilized the bandgap referenced voltage VBGR at it appropriate level.

Figure 9B:
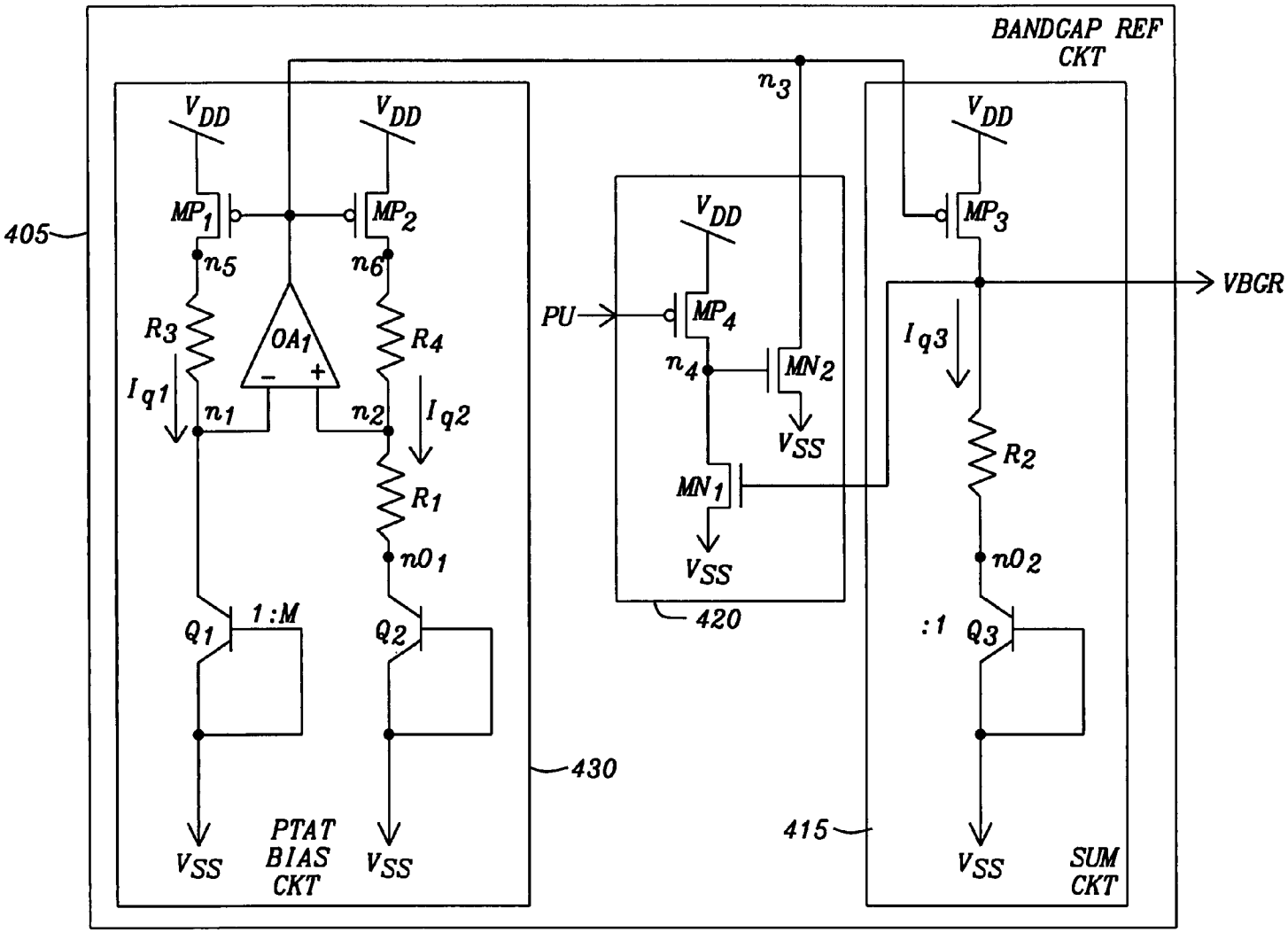

In the eighth embodiment of the speedup circuit 420 of this invention as shown in FIG. 9*b*, the basic structure is essentially similar to the structure of FIGS. 7*a* and 7*b*. The speedup circuit 420 is connected to the node $n_3$ to perform the initiation process of the bandgap referenced voltage source 405. The PTAT biasing circuit 410 provides the PTAT biasing voltage to the node $n_3$ and thus to the summing circuit 415. The structure and function of the PTAT biasing circuit 430 is identical to that of the PTAT biasing circuit 210 of FIGS. 7*a* and 7*b*. In this implementation of the bandgap referenced voltage source 405, the feedback signal is provided to the n-type MOS transistor $MN_1$ from the drain of the p-type MOS transistor $MP_3$ and the top terminal of the resistor $R_2$ from which the bandgap referenced voltage VGBR is generated. In this instance, when the p-type MOS transistor $MP_4$ is turned on thus turning on the n-type MOS transistor $MN_2$, the p-type MOS transistor $MP_3$ is turned on and the second terminal of the resistor $R_2$ increases with the voltage level of the power supply voltage source $V_{DD}$. When the level of the bandgap referenced voltage VBGR reaches a voltage level sufficient to turn on the n-type MOS transistor $MN_1$, the n-type MOS transistor $MN_2$ turns off and the PTAT biasing voltage level begins to stabilized the bandgap referenced voltage VBGR at it appropriate level.

Figure 10:
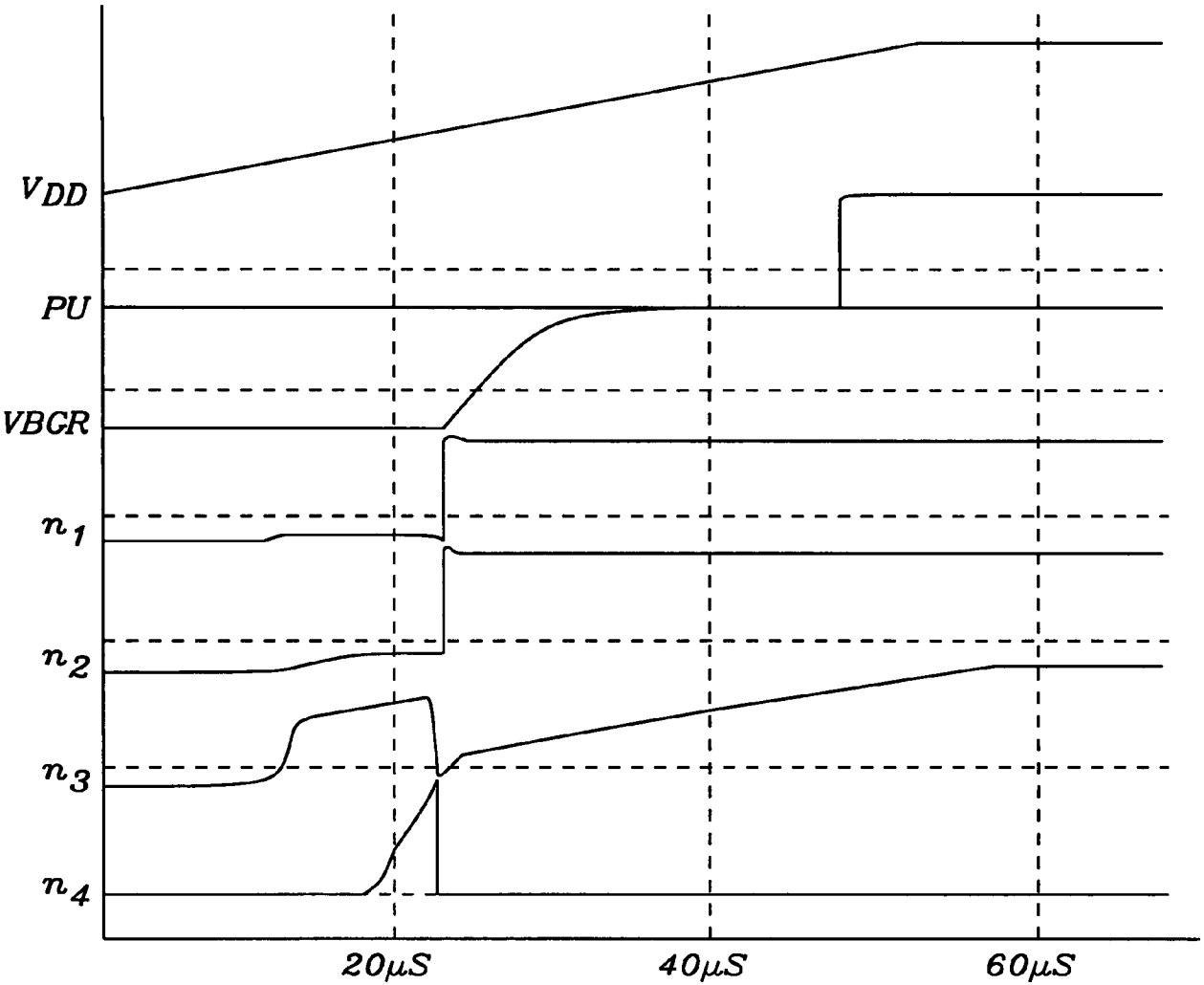
FIGS. 10 and 11 are plots of the operation voltages versus time of the embodiments of the bandgap referenced voltage source of this invention.
Figure 11:
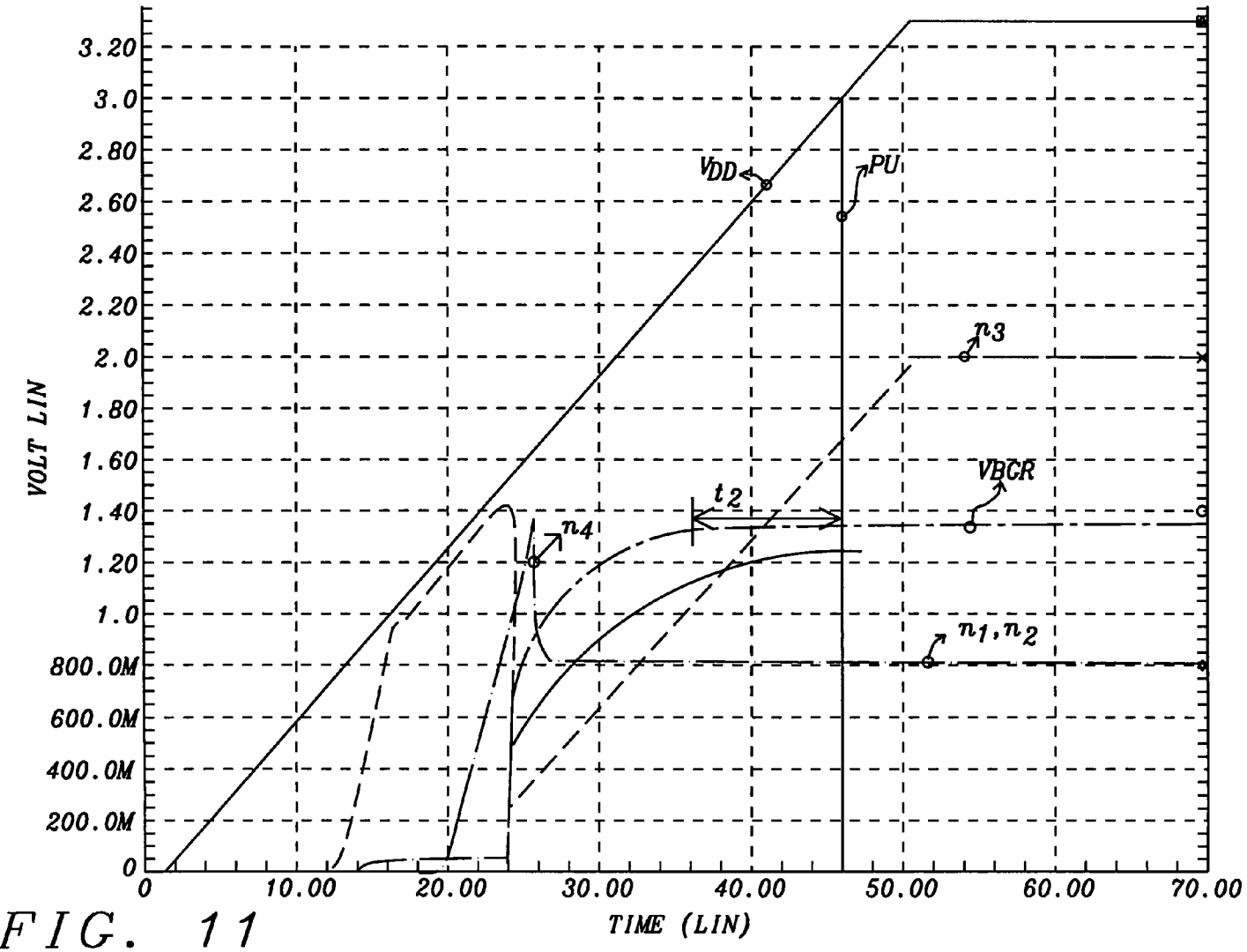

As noted above, each of the embodiments of the of the speedup circuit of this invention and consequently the PTAT biasing circuit and the bandgap referenced voltage source as described operates essentially identically. Refer now to FIGS. 10 and 11 for an explanation of the voltage levels within the bandgap referenced voltage source during the activation of the power supply voltage source $V_{DD}$. As the power supply voltage source $V_{DD}$ increases in voltage and the power-up indication signal PU is deactivated, the p-type MOS transistor $MP_4$ is activated causing node $n_4$ to rise toward approximately the voltage level of the power supply voltage source $V_{DD}$ thus turning on the n-type MOS transistor $MN_2$. The node $n_3$ is then brought to approximately the voltage level of the substrate biasing power supply voltage source $V_{SS}$ causing the p-type MOS transistors $MP_1$, $MP_2$ and $MP_3$ to turn on causing the nodes $n_1$ and $n_2$ and the voltage level VBGR of the node at the top terminal of the resistor $R_2$ and the drain of the p-type MOS transistor $MP_3$ to rise toward the level of the stable bandgap referenced voltage VBGR. The feedback voltage level at the gate of the n-type MOS transistor $MN_1$ rises sufficiently to turn on the n-type MOS transistor $MN_1$ and the voltage at the node $n_4$ approaches the level of the substrate biasing power supply voltage source $V_{SS}$. The n-type MOS transistor $MN_2$ turns off and the node $n_3$ rises to the steady state level of the PTAT biasing voltage and the voltage level VBGR of the node at the top terminal of the resistor $R_2$ and the drain of the p-type MOS transistor $MP_3$ completes the rise toward the level of the stable bandgap referenced voltage VBGR. When the feedback signal activates the n-type MOS transistor $MN_1$, the speedup circuit of this invention is deactivated and the PTAT biasing circuit and the summing circuit achieve their normal operational voltage levels.

While the speed up circuit and the PTAT biasing circuit of this invention are shown as applied to a bandgap referenced voltage source, the speed up circuit and the PTAT biasing circuit may be applied to circuits having a degenerate operating point with a similar configuration. An example of such a circuit would be a temperature sensor. Other similar circuits would incorporate the speed up circuit of this invention and be in keeping with the intent of this invention.

While this invention has been particularly shown and described with reference to the preferred embodiments thereof, it will be understood by those skilled in the art that various changes in form and details may be made without departing from the spirit and scope of the invention.

The invention claimed is:

1. A speed up circuit for initiation of PTAT (proportional to absolute temperature) biasing circuit comprising:

a MOS transistor of a first conductivity type with a source connected to a first power supply voltage source, a gate connected to receive a power indication signal, and a drain;

a first MOS transistor of a second conductivity type with a drain connected to receive a PTAT biasing voltage from said PTAT biasing circuit, a gate in communication with said drain of said MOS transistor of the first conductivity type, and a source connected a second power supply voltage source; and a second MOS transistor of the second conductivity type with a drain in communication with the drain of the MOS transistor of the first conductivity type and the gate of the first MOS transistor of the second conductivity type, a gate connected to receive a feedback signal from said PTAT biasing circuit, and a source connected to the second power supply voltage source;

wherein when said power indication signal denotes that said first power supply voltage source has not achieved a threshold level during activation of said first power supply voltage source, said drain of said MOS transistor of the first conductivity type is at a first voltage level to activate said first MOS transistor of the second conductivity to force said PTAT biasing voltage to a voltage level of said second power supply voltage source; and wherein when said feedback signal indicates that said PTAT biasing circuit has achieved a normal biasing voltage level, said second MOS transistor of the second conductivity type is activated and said first MOS transistor of the second conductivity type is deactivated and said PTAT biasing voltage is set to an active biasing level.

2. A PTAT (proportional to absolute temperature) biasing circuit comprising:

a speed up circuit for initiation of said PTAT (proportional to absolute temperature) biasing circuit comprising:

a first MOS transistor of a first conductivity type with a source connected to a first power supply voltage source, a gate connected to receive a power indication signal, and a drain;

a first MOS transistor of a second conductivity type with a drain connected to receive a PTAT biasing voltage from said PTAT biasing circuit, a gate in communication with said drain of said MOS transistor of the first conductivity type, and a source connected a second power supply voltage source; and a second MOS transistor of the second conductivity type with a drain in communication with the drain of the MOS transistor of the first conductivity type and the gate of the first MOS transistor of the second conductivity type, a gate connected to receive a feedback signal from said PTAT biasing circuit, and a source connected to the second power supply voltage source;

wherein when said power indication signal denotes that said first power supply voltage source has not achieved a threshold level during activation of said first power supply voltage source, said drain of said MOS transistor of the first conductivity type is at a first voltage level to activate said first MOS transistor of the second conductivity to force said PTAT biasing voltage to a voltage level of said second power supply voltage source; and wherein when said feedback signal indicates that said PTAT biasing circuit has achieved a normal biasing voltage level, said second MOS transistor of the second conductivity type is activated and said first MOS transistor of the second conductivity type is deactivated and said PTAT biasing voltage is set to an active biasing level.

3. The PTAT (proportional to absolute temperature) biasing circuit of claim 2 further comprising:

a PTAT biasing generation circuit in communication with the start up circuit to provide the PTAT biasing voltage and the feedback signal to said start up circuit.

4. The PTAT biasing circuit of claim 3 wherein said PTAT biasing generation circuit comprises:

a first diode connected bipolar transistor with a base and collector commonly connected to the second power supply voltage source, and an emitter;

a second diode connected bipolar transistor with a base and collector commonly connected to the second power supply voltage source, and an emitter;

a second MOS transistor of the first conductivity type with a source connected to the first power supply voltage source, a gate, and a drain in communication with the emitter of the first diode connected bipolar transistor to provide a first current to said first diode connected bipolar transistor;

a third MOS transistor of the first conductivity type with a source connected to the first power supply voltage source, a gate, and a drain in communication with the emitter of the second diode connected bipolar transistor to provide a second current to said first diode connected bipolar transistor;

a first resistor with a first terminal connected to receive said second current from the drain of said third MOS transistor of the first conductivity type and a second terminal connected to transfer said second current to the emitter of said second diode connected bipolar transistor to develop a difference base emitter voltage indicating a disparity in a base-emitter voltage of said first diode connected bipolar transistor and a base emitter-voltage said second diode connected bipolar transistor; and an operational amplifier with inputs connected to receive and amplify the base-emitter voltage of said first diode connected bipolar transistor and a base emitter-voltage said second diode connected bipolar transistor to generate said PTAT biasing voltage.

5. The PTAT biasing circuit of claim 4 wherein said feedback signal is the base-emitter voltage of said first diode connected bipolar transistor.

6. The PTAT biasing circuit of claim 4 wherein said feedback signal is the base emitter-voltage said second diode connected bipolar transistor.

7. The PTAT biasing circuit of claim 4 wherein the PTAT biasing generation circuit further comprises:

a second resistor with a first terminal connected to receive the first current and a second terminal to transfer said first current to the emitter of the first diode connected bipolar transistor.

8. The PTAT biasing circuit of claim 7 wherein said feedback signal is generated at the first terminal of the second resistor.

9. The PTAT biasing circuit of claim 4 wherein the PTAT biasing generation circuit further comprises:

a third resistor with a first terminal connected to receive the second current and a second terminal to transfer said second current to the first terminal of the first resistor and thence to the emitter of the second diode connected bipolar transistor.

10. The PTAT biasing circuit of claim 8 wherein said feedback signal is generated at the first terminal of the third resistor.

11. A bandgap reference circuit for generation of a bandgap referenced voltage comprising:

a speed up circuit for initiation of bandgap reference circuit comprising:

a first MOS transistor of a first conductivity type with a source connected to a first power supply voltage source, a gate connected to receive a power indication signal, and a drain;

a first MOS transistor of a second conductivity type with a drain connected to receive a PTAT biasing voltage from said PTAT biasing circuit, a gate in communication with said drain of said MOS transistor of the first conductivity type, and a source connected a second power supply voltage source; and a second MOS transistor of the second conductivity type with a drain in communication with the drain of the MOS transistor of the first conductivity type and the gate of the first MOS transistor of the second conductivity type, a gate connected to receive a feedback signal from said PTAT biasing circuit, and a source connected to the second power supply voltage source;

wherein when said power indication signal denotes that said first power supply voltage source has not achieved a threshold level during activation of said first power supply voltage source, said drain of said MOS transistor of the first conductivity type is at a first voltage level to activate said first MOS transistor of the second conductivity to force said PTAT biasing voltage to a voltage level of said second power supply voltage source; and wherein when said feedback signal indicates that said PTAT biasing circuit has achieved a normal biasing voltage level, said second MOS transistor of the second conductivity type is activated and said first MOS transistor of the second conductivity type is deactivated and said PTAT biasing voltage is set to an active biasing level.

12. The bandgap reference circuit of claim 11 further comprising:

a PTAT biasing generation circuit in communication with the start up circuit to provide the PTAT biasing voltage and the feedback signal to said start up circuit.

13. The bandgap reference circuit of claim 12 wherein said PTAT biasing generation circuit comprises:

a first diode connected bipolar transistor with a base and collector commonly connected to the second power supply voltage source, and an emitter;

a second diode connected bipolar transistor with a base and collector commonly connected to the second power supply voltage source, and an emitter;

a second MOS transistor of the first conductivity type with a source connected to the first power supply voltage source, a gate, and a drain in communication with the emitter of the first diode connected bipolar transistor to provide a first current to said first diode connected bipolar transistor a third MOS transistor of the first conductivity type with a source connected to the first power supply voltage source, a gate, and a drain in communication with the emitter of the second diode connected bipolar transistor to provide a second current to said first diode connected bipolar transistor;

a first resistor with a first terminal connected to receive said second current from the drain of said third MOS transistor of the first conductivity type and a second terminal connected to transfer said second current to the emitter of said second diode connected bipolar transistor to develop a difference base emitter voltage indicating a disparity in a base-emitter voltage of said first diode connected bipolar transistor and a base emitter-voltage said second diode connected bipolar transistor; and an operational amplifier with inputs connected to receive and amplify the base-emitter voltage of said first diode connected bipolar transistor and a base emitter-voltage said second diode connected bipolar transistor to generate said PTAT biasing voltage.

14. The bandgap reference circuit of claim 13 wherein said feedback signal is the base-emitter voltage of said first diode connected bipolar transistor.

15. The bandgap reference circuit of claim 13 wherein said feedback signal is the base emitter-voltage said second diode connected bipolar transistor.

16. The bandgap reference circuit of claim 13 wherein the PTAT biasing generation circuit further comprises:

a second resistor with a first terminal connected to receive the first current and a second terminal to transfer said first current to the emitter of the first diode connected bipolar transistor.

17. The bandgap reference circuit of claim 16 wherein said feedback signal is generated at the first terminal of the second resistor.

18. The bandgap reference circuit of claim 13 wherein the PTAT biasing generation circuit further comprises:

a third resistor with a first terminal connected to receive the second current and a second terminal to transfer said second current to the first terminal of the first resistor and thence to the emitter of the second diode connected bipolar transistor.

19. The bandgap reference circuit of claim 18 wherein said feedback signal is generated at the first terminal of the third resistor.

20. The bandgap reference circuit of claim 11 further comprising:

a bandgap summing circuit for summing the PTAT biasing voltage with a bipolar transistor base emitter voltage to generate the bandgap referenced voltage.

21. The bandgap reference circuit of claim 20 wherein said bandgap summing circuit comprises:

a fourth MOS transistor of the first conductivity type with a source connected to the first power supply voltage source, a gate connected to receive the PTAT biasing voltage, and a drain;

a fourth resistor with a first terminal connected to receive a third current transferred from said drain of the fourth MOS transistor of the first conductivity type, and a second terminal to transfer said third current; and a third diode connected bipolar transistor with a base and collector commonly connected to the second power supply voltage source and an emitter connected to receive said third current from said second terminal of said fourth resistor;

wherein said bandgap reference voltage is generated at the second terminal of said fourth resistor.

22. The bandgap reference circuit of claim 21 wherein said feedback signal is said bandgap reference voltage.

* * * * *